US008429779B2

(12) United States Patent
Eigenmann et al.

(10) Patent No.: US 8,429,779 B2
(45) **Date of Patent: *Apr. 30, 2013**

(54) BEDDING OR SEATING PRODUCT MADE WITH COIL SPRINGS HAVING UNKNOTTED END TURNS WITH BUMPS

(75) Inventors: Guido Eigenmann, Carthage, MO (US); Niels S. Mossbeck, Carthage, MO (US); Darrell A. Richmond, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 450 days.

This patent is subject to a terminal disclaimer.

(21) Appl. No.: 12/830,522

(22) Filed: Jul. 6, 2010

(65) Prior Publication Data

US 2010/0299839 A1 Dec. 2, 2010

Related U.S. Application Data

(60) Division of application No. 11/954,660, filed on Dec. 12, 2007, now Pat. No. 7,921,561, and a continuation-in-part of application No. 11/148,941, filed on Jun. 9, 2005, now Pat. No. 7,386,897, and a continuation-in-part of application No. 29/282,036, filed on Jul. 10, 2007, now Pat. No. Des. 574,168, and a continuation-in-part of application No. 29/283,010, filed on Aug. 3, 2007, now Pat. No. Des. 575,564.

(51) Int. Cl.
*A47C 23/04* (2006.01)

(52) U.S. Cl.
USPC ..... 5/716; 5/248; 5/256; 5/267; 267/103

(58) Field of Classification Search ..... 29/896.9, 29/896.92, 896.93; 5/248, 255, 256, 267, 5/269, 271, 655.7, 716; 267/103
See application file for complete search history.

(56) References Cited

U.S. PATENT DOCUMENTS

| | | | |
|---|---|---|---|
| 2,853,721 | A | 9/1958 | Koenigsberg |
| 4,609,186 | A | 9/1986 | Thoenen |
| 4,726,572 | A | 2/1988 | Flesher et al. |
| 4,760,616 | A | 8/1988 | Hiatt et al. |
| 4,781,360 | A | 11/1988 | Ramsey |
| 4,817,924 | A | 4/1989 | Thoenen |
| 5,444,905 | A | 8/1995 | St. Clair |
| 5,575,460 | A | 11/1996 | Knopfel |
| 5,584,083 | A | 12/1996 | Ramsey et al. |
| D382,741 | S | 8/1997 | Eigenmann |
| 5,699,999 | A | 12/1997 | Wells |
| 6,295,676 | B1 | 10/2001 | Warner |

(Continued)

*Primary Examiner* — David Bryant
*Assistant Examiner* — Ryan J Walters
(74) *Attorney, Agent, or Firm* — Wood, Herron & Evans, LLP

(57) ABSTRACT

Disclosed herein is a bedding or seating product (10) having a spring core (12) comprising coil springs (26) having unknotted end turns (72, 74) made from high tensile strength wire. In each embodiment, the end turns (72, 74) of the coil springs (26) are generally U-shaped having one arcuate leg (76) longer than the other (78), the legs (76, 78) being joined by a connector (80) having an arcuate bump (81) therein. The springs (26) are oriented in the spring core (12) such that a long leg (76) of one end turn (72) abuts a short leg (78) of the adjacent end turn (72) prior to be wrapped in helical lacing wire (32). The high tensile wire enables the coil springs (26) to be manufactured using less wire than heretofore possible.

23 Claims, 16 Drawing Sheets

U.S. PATENT DOCUMENTS

| | | | |
|---|---|---|---|
| 6,375,169 | B1 | 4/2002 | McCraw et al. |
| 6,758,078 | B2 | 7/2004 | Wells et al. |
| 6,948,348 | B2 | 9/2005 | Wells et al. |
| 7,044,454 | B2 | 5/2006 | Colman et al. |
| 7,063,309 | B2 | 6/2006 | Colman |
| D528,329 | S | 9/2006 | Eigenmann et al. |
| D528,330 | S | 9/2006 | Eigenmann et al. |
| D528,833 | S | 9/2006 | Eigenmann et al. |
| D531,436 | S | 11/2006 | Eigenmann et al. |
| 7,178,187 | B2 | 2/2007 | Barman et al. |
| 7,386,897 | B2 | 6/2008 | Eigenmann et al. |
| D574,168 | S | 8/2008 | Eigenmann et al. |
| D575,564 | S | 8/2008 | Eigenmann et al. |
| 7,921,561 | B2 | 4/2011 | Eigenmann et al. |
| 2002/0124531 | A1 | 9/2002 | Mossbeck et al. |
| 2004/0046297 | A1 | 3/2004 | DeMoss et al. |
| 2006/0277686 | A1* | 12/2006 | Eigenmann et al. ..... 5/716 |

* cited by examiner

BEDDING OR SEATING PRODUCT MADE WITH COIL SPRINGS HAVING UNKNOTTED END TURNS WITH BUMPS

CROSS-REFERENCE TO RELATED APPLICATIONS

This application is a divisional of U.S. patent application Ser. No. 11/954,660, filed Dec. 12, 2007, entitled "Bedding or Seating Product Made With Coil Springs Having Unknotted End Turns With Bumps", which is fully incorporated by reference herein. U.S. patent application Ser. No. 11/954,660 is a continuation-in-part of U.S. patent application Ser. No. 11/148,941, filed Jun. 9, 2005, now U.S. Pat. No. 7,386,897, issued Jun. 17, 2008, which is fully incorporated by reference herein. This application is also a continuation-in-part of U.S. Design patent application Ser. No. 29/282,036, filed Jul. 10, 2007, now U.S. Pat. No. D574,168, issued Aug. 5, 2008, which is fully incorporated by reference herein. This application is also a continuation-in-part of U.S. Design patent application Ser. No. 29/283,010, filed Aug. 3, 2007, now U.S. Pat. No. D575,564, issued Aug. 26, 2008, which is fully incorporated by reference herein.

FIELD OF THE INVENTION

This invention relates generally to bedding or seating products and more particularly to a spring core for a mattress made up of identically formed coil springs having unknotted end turns.

BACKGROUND OF THE INVENTION

Traditionally, spring cores for mattresses have consisted of a plurality of spaced parallel rows of helical coil springs mounted between border wires; coil springs adjacent the border wires being attached thereto via helical lacing wires, sheet metal clips or other connectors. The upper and lower end turns of adjacent coil springs are generally connected to each other by helical lacing wires. Coil springs are arranged in longitudinally extending columns and transversely extending rows. Padding and upholstery commonly are secured to opposed surfaces of the spring core, thereby resulting in what is known in the industry as a two-sided mattress for use on either side.

Recently, spring cores have been developed having only one border wire to which the end turns of the outermost coil springs are secured. After padding and/or other materials are placed over the upper surface of the spring core in which the border wire is located, an upholstered covering is sewn or secured around the spring core and cushioning materials, thereby creating what is known in the industry as a one-sided or single-sided mattress.

The upper and lower end turns of unknotted coil springs often are made with straight portions or legs which abut one another when coil springs are placed next to each other. For example in U.S. Pat. No. 4,726,572, the unknotted end turns of the coil springs have relatively straight legs of an identical length. Adjacent coil wire. One leg of an end turn of a coil spring is set beside the opposite leg of an end turn of the adjacent coil spring. The side-by-side legs are laced together with helical lacing wire.

When assembled, coil springs of such a spring core may move within the helical lacing wire, causing misalignment or nonparallel alignment of coils in adjacent rows of coils. This misalignment causes the coil springs to line up improperly. The lines connecting the central axes of the coil springs no longer form a 90 degree angle as they should. This misalignment changes a rectangular or square spring core into a rhombus. Such an odd shape must then be corrected at additional cost. This will, in most cases, result in compression problems when a spring unit is compressed for shipping purposes. Misaligned coils will be damaged in the forced compression/decompression. In a mattress construction, wrongly compressed coils will result in an uneven sleep surface. This uneven sleep surface will be visible to a consumer after the cushioning materials, such as foam and fibrous materials take their set, normally after a few months of use.

In order to avoid this misalignment problem, spring cores have been developed having individual coil springs with U-shaped end turns having one leg of a greater length than its opposing leg, as in U.S. Pat. No. 4,817,924. Once again, adjacent coil springs of the spring core of U.S. Pat. No. 4,817,924 are connected with helical lacing wire at their end turns. However, due to the difference in leg lengths of the U-shaped end turns, the helical lacing wire wraps one more revolution around the longer leg of the U-shaped end turn than around the shorter leg of the U-shaped end turn of the adjacent coil spring. The different leg lengths bound together with helical lacing wire corrects the misalignment or coil offset situation.

Coil springs with unknotted end turns, such as those disclosed in U.S. Pat. Nos. 5,584,083 and 4,817,924, have upper and lower end turns which are rotated approximately 180 degrees in relation to each other to dispose the shorter and longer legs of the upper end turn in mirror symmetry to the shorter and longer legs, respectively, of the associated lower end turn. Such an orientation eases the manufacturing process by allowing all the coil springs of the spring core to be oriented in an identical manner except for one outermost row (or column) of coil springs, the coil springs of which are rotated relative to the remainder of the coil springs in order to enable the end turns of all of the coil springs to be secured to the border wires. The identical orientation of the coil springs (except for the one row or column) allows the long leg of an end turn of one coil spring to be helically laced with the shorter leg of the end turn of the adjacent coil spring for reasons described above.

One drawback to a spring core assembled in such a manner is that the coil springs may exhibit a pronounced tendency to incline laterally away from the open end of the end turn when a load is placed on them. One solution which has been utilized to overcome this leaning tendency has been to orient the coil springs having unknotted end turns in a checkerboard fashion within the spring core, every other coil spring within a particular row or column being twisted 180 degrees so the free end of the end turns are helically laced together, as shown in U.S. Pat. No. 6,375,169. However, to align the coil springs in such a checkerboard manner may be difficult to do on an automated machine, time consuming and therefore expensive.

In order to reduce the coil count of a spring core (the number of coil springs used in a particular sized product) and therefore, the expense of the spring core, it may be desirable to incorporate into the spring core coil springs having unknotted end turns which are substantially larger than the diameter of the middle or central spiral portion of the coil spring. Prior to the present invention, such coil springs exhibited exaggerated lean tendencies, i.e. the greater the head size or size of the end turns, the greater the lean when a load was placed on the coil spring.

Therefore, there is a need for an unknotted coil spring which does not lean or deflect in one direction when loaded.

The greatest expense in manufacturing spring cores or assemblies is the cost of the raw material, the cost of the steel used to make the coil springs which are assembled together. Currently, and for many years, the wire from which unknotted coil springs have been manufactured has a tensile strength no greater than 290,000 psi. This standard wire, otherwise known as AC&K (Automatic Coiling and Knotting) grade wire has a tensile strength on the order of 220,000 to 260,000 and is thicker, i.e. has a greater diameter, than high tensile strength wire, i.e. wire having a tensile strength greater than 290,000 psi. In order to achieve the same resiliency or bounce back, a coil spring made of standard gauge wire must have one half an additional turn when compared to a coil spring made of high tensile wire. In other words, the pitch of the coil springs made of high tensile wire may be greater as compared to coil springs made of standard wire. Coil springs made of high tensile strength wire also do not tend to set or permanently deform when placed under significant load for an extended period of time, i.e. during shipping. Therefore, there is a desire in the industry to make coil springs having unknotted end turns of high tensile strength wire because less wire is necessary to manufacture each coil spring.

Although coil springs made of high tensile strength wire may be desirable for the reasons stated above, coil springs made of wire having too high a tensile strength are too brittle and may easily shatter or break. Therefore, there is a window of desirable tensile strength of the wire used to make coil springs having unknotted end turns.

SUMMARY OF THE INVENTION

The invention of this application provides a bedding or seating product, comprising a spring core or spring assembly made up of a plurality of identically configured coil springs, padding overlaying at least one surface of the spring core and an upholstered covering encasing the spring core and the padding. Each coil spring is made of a single piece of wire having a central spiral portion of a fixed radius defining a central spring axis and terminating at opposing ends with unknotted upper and lower end turns disposed in planes substantially perpendicular to the spring axis.

The bedding or seating product has a longitudinal dimension or length extending from one end surface to the opposing end surface of the product. Similarly, the product has a transverse dimension or width extending from one side surface to the opposed side surface. Typically, the longitudinal dimension is greater than the transverse dimension; however, square products having identical longitudinal and transverse dimensions are within the scope of the present invention.

The coil springs of the product are arranged in transversely extending side-by-side rows and longitudinally extending side-by-side columns connected with each other at the upper and lower end turns by helical lacing wires. In most embodiments of the present invention, the helical lacing wires run transversely or from side-to-side of the product in the planes of the upper and lower end turns of the coil springs. However, it is within the contemplation of the present invention that the helical lacing wires extend in a longitudinal direction or from head to foot of the product. The end turns of the outermost coil springs are secured to at least one border wire.

Each of the upper and lower end turns is substantially U-shaped, having a long leg and a short leg joined by an arcuate or curved connector. In one embodiment of the present invention, the long leg is located at the free unknotted end of each of the end turns. In this embodiment, the long legs of each of the end turns are located on the same side of the central spiral portion of the coil spring, i.e., on the same side of the spring axis. In this embodiment, the open side of one end turn (oppose the connector) of each coil spring is oriented opposite the open side of the other end turn (oppose the connector) of the coil spring. In other words, the open sides of the end turns are on opposed sides of the central spiral portion and spring axis of the coil spring. Consequently, only one border wire may be secured to the end turns of the outermost coil springs because the border wire may not be secured to an open side of an end turn.

In each embodiment of the present invention, the coil springs are oriented in the spring core with the long leg of one end turn being adjacent to the short leg of the adjacent end turn of an adjacent coil spring, the helical lacing wire encircling them both for reasons described above. In this embodiment, in order to secure one border wire to the outermost coil springs, one outermost column or row of coil springs must be rotated around its axis.

Alternative embodiments of the present invention comprise two-sided bedding or seating products each having a spring core made of identical coil springs laced together at their unknotted end turns, the unknotted end turns of the outermost coil springs being secured to upper and lower border wires. In such embodiments, the coil springs are oriented in the spring core in the same manner except the coil springs along the outermost columns. In order to secure upper and lower border wires to the end turns of the coil springs in these two outermost columns, every other coil spring must be rotated and flipped in an assembler prior to being clipped to a border wire. Thus, every coil spring along the outermost columns is clipped to only one border wire.

In these alternative embodiments, each coil spring is identically formed with unknotted end turns, each end turn being substantially U-shaped, having an arcuate long leg and an arcuate short leg joined by an arcuate or curved connector. In one such embodiment, the connector of each end turn has a bump to aid in securing the end turns to the border wires of the product. Each coil spring has an end turn having its long leg located at the free unknotted end of the end turn. The other end turn of the coil spring has its short leg located at the free unknotted end of the end turn. In these embodiments, the free unknotted ends of the end turn are on the same side of the central spiral portion and central spring axis of the coil spring. In these alternative embodiments, the open side of one end turn (oppose the connector) of each coil spring is oriented opposite the open side of the other end turn (oppose the connector) of the coil spring and the connectors of the end turns are on opposite sides of the central spiral portion and central spring axis of the coil spring. Consequently, to secure one end turn of the outermost coil springs to the border wires, every other coil spring along the outermost columns must be rotated and flipped in an automated manner prior to being secured along the connector to only one of the border wires. In one embodiment, the bumps of the connectors of the end turns of the coil springs along the outermost columns are connected or clipped to one of the border wires.

According to another aspect of the present invention, in any of the embodiments described herein, the end turns may be enlarged relative to the diameter of the central spiral portion of the coil spring. In such embodiments, the legs of each end turn are laterally outwardly spaced from the central spiral portion in relation to the central spring axis. In such instances, the lateral distance between one of the legs of each end turn and the central spring axis is greater than the lateral distance between the other of the legs and the central spring axis. In select embodiments, the lateral distance between one of the legs of each end turn and the central spring axis is at least two times greater than the lateral distance between the other of the legs and the central spring axis. The legs of the end turns at the free ends of the end turns are the ones furthest away from the central spiral portion and central axis of the coil spring.

In each of the embodiments, all of the coil springs are preferably oriented within the spring core so they all are of the same hand, a term known in the industry. For example, all of the coil springs rotate in the same direction (clockwise or counter-clockwise) as the wire winds or extends down around the central spiral axis of the coils spring.

In each of the embodiments, the coil springs are made from high tensile strength wire. This high tensile wire has a tensile strength over 290,000 psi and generally in the range of 290,000 psi to 320,000 psi. Heretofore, coil springs having unknotted end turns were manufactured from AC&K (Automatic Coiling and Knotting) grade wire having a tensile strength on the order of 220,000 to 260,000 psi. By utilizing a high tensile strength wire to form these coil springs, it is possible to use smaller diameter wire than that which has been heretofore used to form coil springs having unknotted end turns and still obtain spring performance which is similar or better than that of coil springs having unknotted end turns made from AC&K grade wire. Because the wire is high tensile strength wire, it is possible to make a coil spring having fewer turns or revolutions while still obtaining equal or better performance characteristics, i.e., resiliency and firmness.

The primary advantage of this invention is that it enables less wire to be utilized in the manufacture of coil springs than has heretofore been possible while still maintaining the same or better performance characteristics, i.e., resiliency and set when compressed. In fact, the savings in the quantity of material utilized in obtaining springs of the same characteristics may range anywhere from 10 to 30% compared to traditional coil springs having unknotted end turns or so-called "LFK" springs currently being manufactured from conventional AC&K grade wire.

The practice of this invention results in a substantial wire cost savings as a consequence of utilizing less wire than has heretofore been required to manufacture coil springs having unknotted end turns having identical performance characteristics. This invention also requires a minimum degree of change to existing machinery and equipment utilized to manufacture conventional coil springs having unknotted end turns.

These and other advantages of this invention will be readily apparent to those skilled in this art upon review of the following brief and detailed descriptions of the invention.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments below, serve to explain the principles of the invention.

DETAILED DESCRIPTION OF THE DRAWINGS

Figure 1:
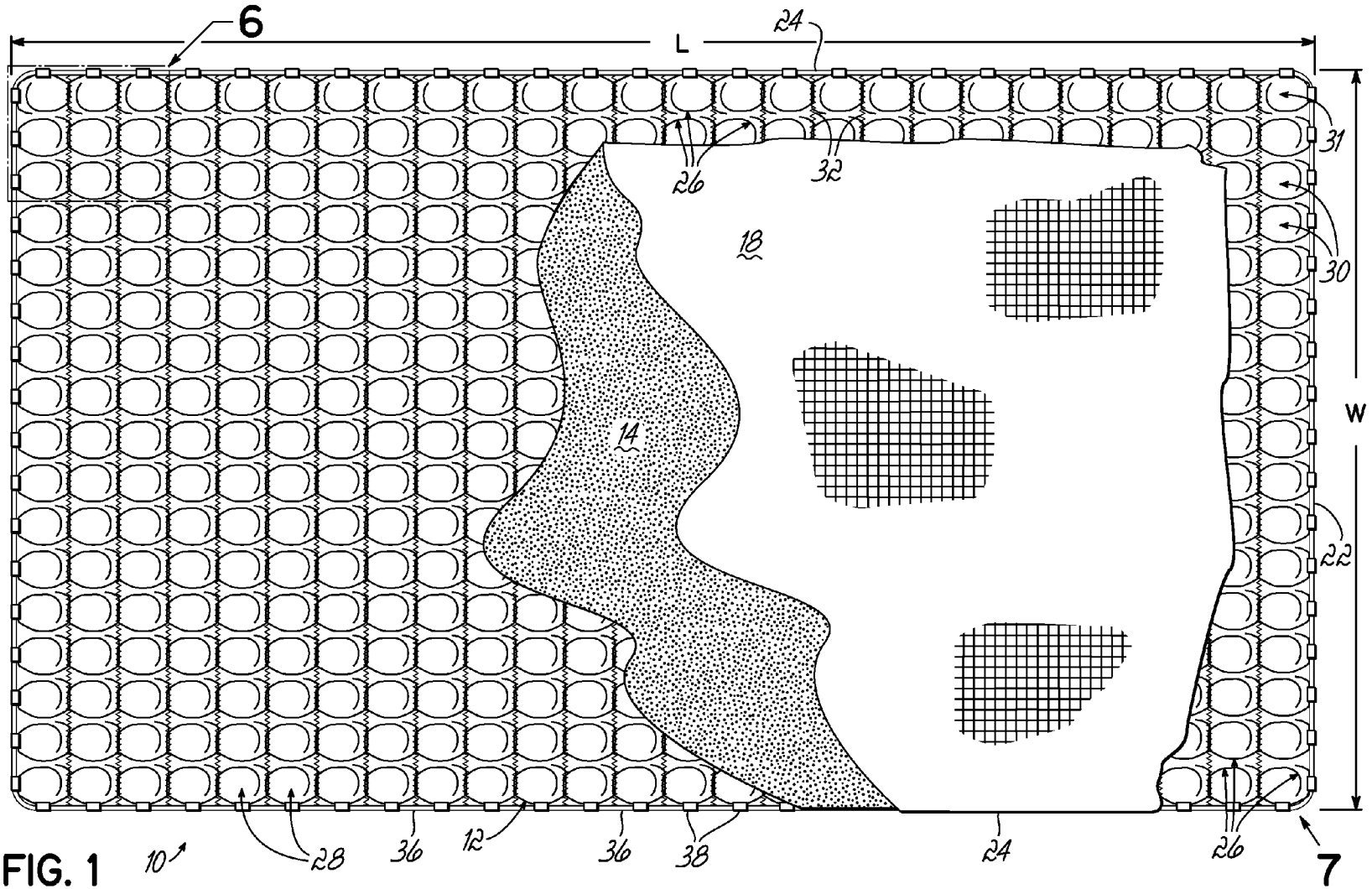
FIG. 1 is a top view of a bedding or seating product having a spring core made in accordance with one aspect of the present invention.

Referring to the drawings and particularly to FIG. 1, there is illustrated a bedding or seating product in the form of a mattress 10 made in accordance with one aspect of the present invention. Although a mattress 10 is illustrated, any aspect of the present invention may be used to construct any bedding or seating product. The mattress 10 comprises a spring core or spring assembly 12, padding 14 located on top of an upper surface 16 of the mattress 10 (see FIG. 7) and an upholstered covering 18 surrounding the spring core 12 and padding 14.

Figure 7:
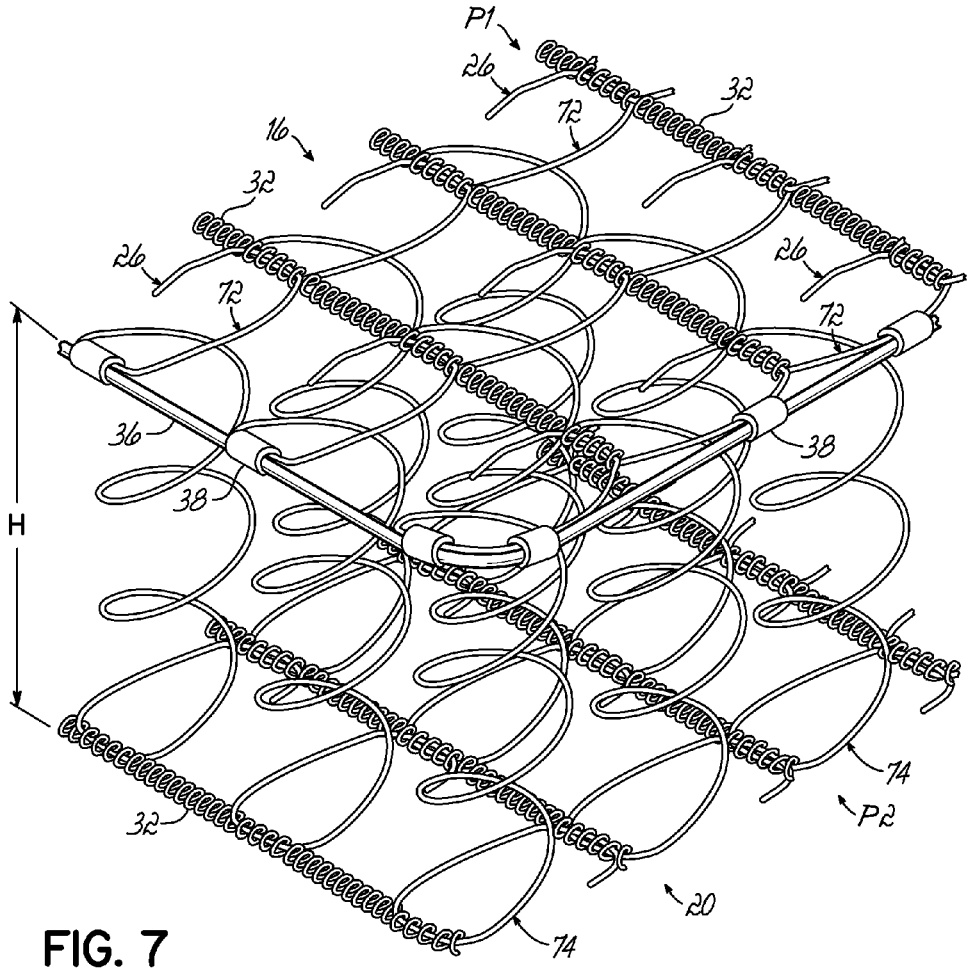
FIG. 7 is a perspective view of a portion of the spring core of FIG. 1 looking from the direction of arrow 7 of FIG. 1.

As shown in FIG. 7, the generally planar upper surface 16 of the product 10 is located generally in a plane P1. Similarly, the product 10 has a generally planar lower surface 20 located generally in a plane P2. The distance between the upper and lower surfaces 16, 20 of the product 10 is defined as the height H of the product 10. See FIG. 7. Referring back to FIG. 1, the product 10 has a longitudinal dimension or length L defined as the distance between opposed end surfaces 22 and a transverse dimension or width W defined as the distance between opposed side surfaces 24.

Figure 5:
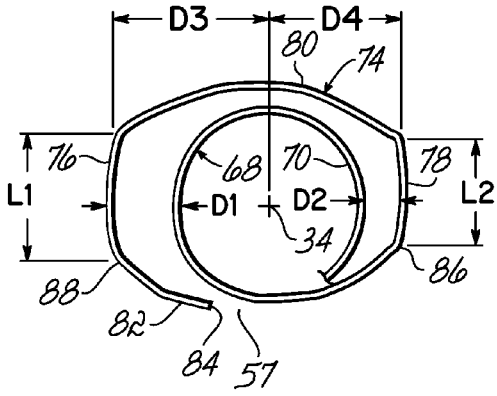
FIG. 5 is view taken along the line 5-5 of FIG. 3 showing the unknotted lower end turn of the coil spring of FIG. 3.
Figure 6:
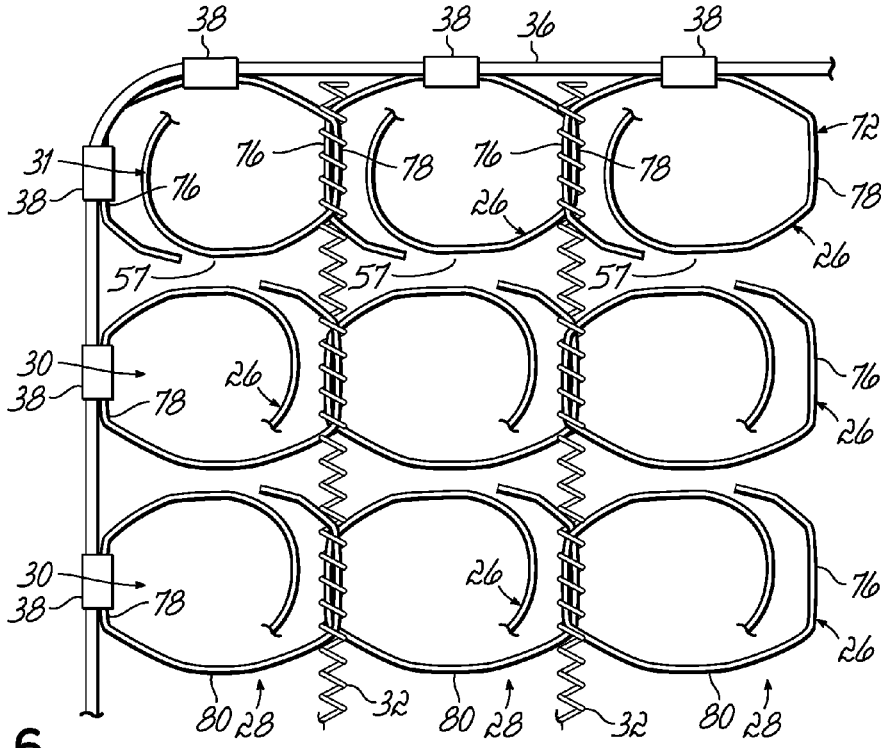
FIG. 6 is an enlarged top view of the portion of the product illustrated in dashed lines in FIG. 1.

As best illustrated in FIGS. 1, 6 and 7, the spring core 12 comprises a plurality of aligned identical coil springs 26 made in accordance with one aspect of the present invention. One of the coil springs 26 is illustrated in detail in FIGS. 3, 3A, 3B, 3C, 4 and 5. Referring to FIG. 1, the coil springs 26 are arranged in transversely extending rows 28 and longitudinally extending columns 30. Helical lacing wires 32 extending transversely and located generally in the upper and lower surfaces 16, 20 of the spring core 12 join adjacent rows 28 of coil springs 26 together in a manner described below. The coil springs 26 are of the same hand; the wire extends in a clockwise direction as the wire moves down the coil spring (from top to bottom). See FIG. 1.

As best illustrated in FIGS. 1 and 6, the coil springs 26 are oriented the same direction within the spring core 12 with the exception of the coil springs 26 of one outermost column 31. The coil springs 26 of the column 31 are rotated 180 degrees about the central spring axes 34 of the coil springs 26 relative to the coil springs 26 within columns 30. This rotation of the coil springs 26 enables each of the outermost coil springs 26 to be clipped or otherwise secured to an upper border wire 36 with clips 38. See FIGS. 1, 6 and 7.

FIGS. 2, 2A, 2B and 2C illustrate a prior art coil spring 40 made of a single piece of wire having a central spiral portion 42 made up of a plurality of consecutive helical loops or revolutions 44 of the same diameter defining a central spring axis 46. The prior art coil spring 40 has an unknotted upper end turn 48 disposed substantially in a plane P3 and an unknotted lower end turn 50 disposed substantially in a plane P4, planes P3 and P4 being substantially perpendicular to central spring axis 46. See FIG. 2B. Each of the unknotted end turns 48, 50 are identically formed, each being substantially U-shaped and having a long leg 52 and a short leg 54 joined together with an arcuate or curved connector 56. The long leg 52 is located on the free unknotted end of each of the end turns 48, 50. The long leg 52 of each end turn 48, 50 extends into a tail piece or portion 58 having an end 60. Each of the end turns 48, 50 joins the central spiral portion 42 at location 62 and each of the long legs 52 joins the tail piece 58 at location 64. The opposing end turns 48, 50 are rotated approximately 180 degrees in relation to each other to dispose the long and short legs 52, 54, respectively of the upper end turn 48 of each prior art coil spring 40 in mirror symmetry to the long and short legs 52, 54, respectively, of the associated lower end turn 50. Consequently, the long legs 52 of the end turns 48, 50 are located on opposite sides of the central spiral portion 42 and opposite sides of the central spiral axis 46. See FIG. 2A.

Figure 2:
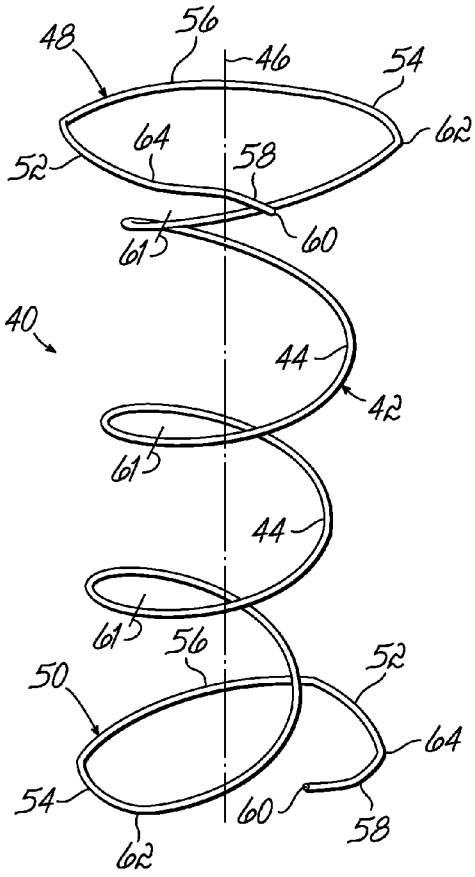
PRIOR ART FIG. 2
FIG. 2 is a perspective view of a prior art coil spring having unknotted end turns.

This prior art spring 40 is known in the industry as a standard "LFK" spring which has 4.75 turns or revolutions. The first and lowermost turn begins at free end 60 and terminates at one end of short leg 54 or location 62. The end of each successive turn is shown in FIG. 2 with a mark 61. The upper end turn 48 is considered to be a three quarter turn, less than a full turn.

Figure 2A:
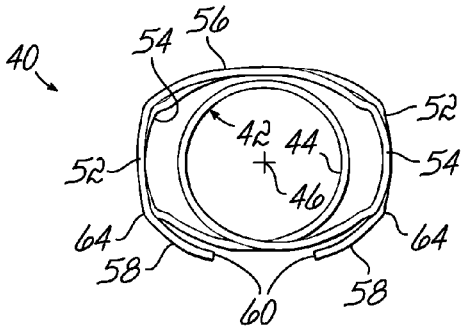
PRIOR ART FIG. 2A
FIG. 2A is a top view of the prior art coil spring of FIG. 2.
Figure 2B:
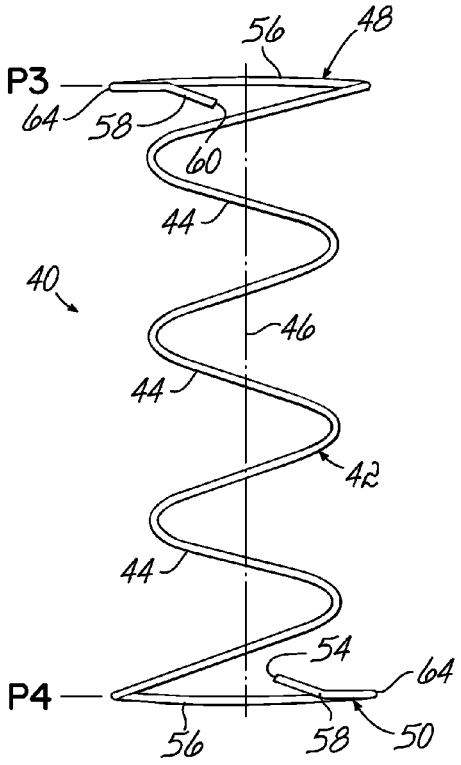
PRIOR ART FIG. 2B
FIG. 2B is a side elevational view of the prior art coil spring of FIG. 2.
Figure 2C:
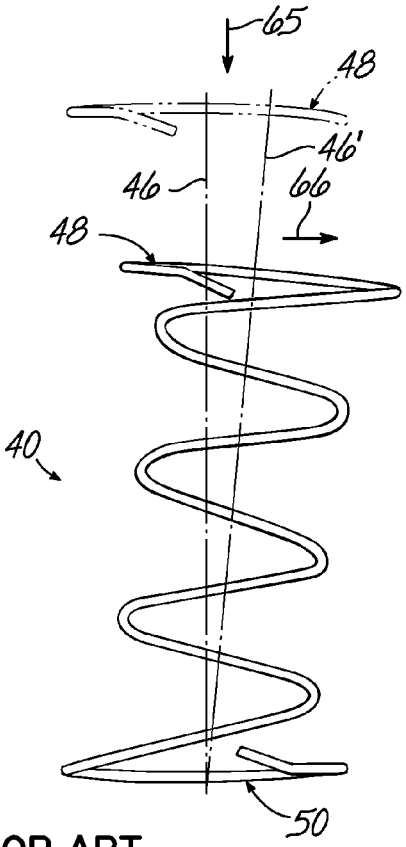
PRIOR ART FIG. 2C
FIG. 2C is a side elevational view of the prior art coil spring of FIG. 2 in a compressed condition.

As shown in FIG. 2C, when a downwardly directed load (see arrow 65) is placed on a standard "LFK" coil spring, such as the prior art coil spring 40 shown in FIG. 2, the coil spring 40 leans in a lateral direction towards the shorter leg 54 of the upper end turn 48, in the direction of arrow 66. FIGS. 2A and 2B illustrate the prior art coil spring 40 at rest with no load placed thereon. In such a relaxed unloaded condition, the central spring axis 46 is vertical. FIG. 2C illustrates the prior art coil spring 40 compressed or loaded in the direction of arrow 65 so that the upper end turn 48 moves from the position shown in dashed lines to the position shown in solid lines. In its compressed or loaded condition, the central spring axis 46 is no longer vertical but rather inclined in a position shown by number 46' in FIG. 2C so as to form an acute angle with the vertical axis. Such lean is undesirable in a coil spring and is eliminated with the present invention, as will be described in detail below. Again, the larger the end turns of the prior art coil springs 40, the greater the lean.

Figure 3:
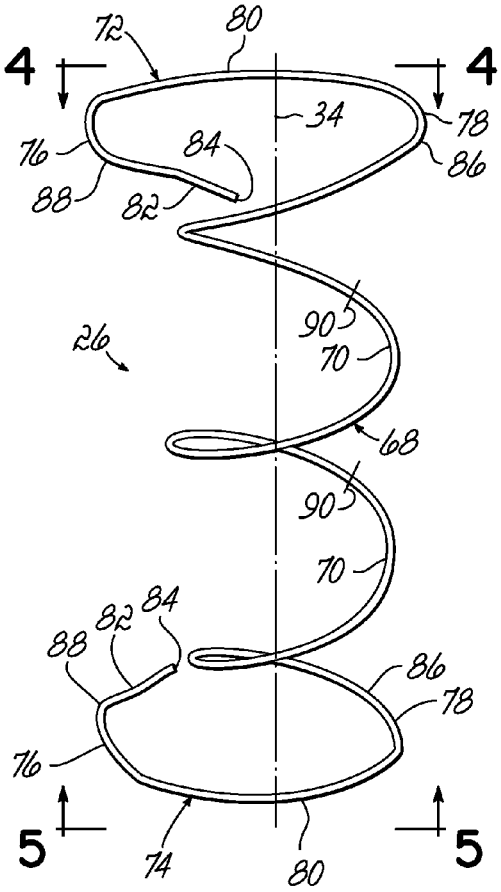
FIG. 3 is a perspective view of a coil spring used in the spring core of FIG. 1 having unknotted end turns made in accordance with one aspect of the present invention.
Figure 3A:
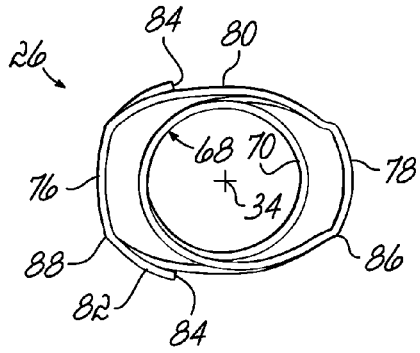
FIG. 3A is a top view of the coil spring of FIG. 3.
Figure 3B:
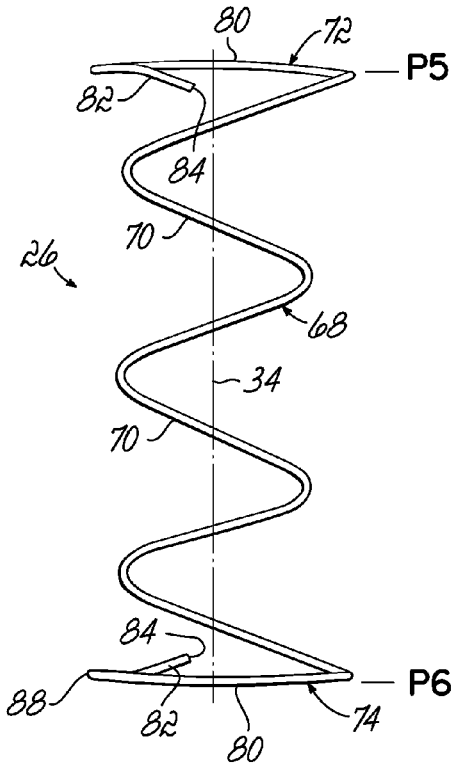
FIG. 3B is a side elevational view of the coil spring of FIG. 3.

FIGS. 3, 3A, 3B, 3C, 4 and 5 illustrate one embodiment of coil spring 26 made in accordance with the present invention. FIGS. 3, 3A and 3B illustrate coil spring 26 in a relaxed or uncompressed condition. Coil spring 26 is made of a single piece of wire having a central spiral portion 68 made up of a plurality of consecutive helical loops or revolutions 70 of the same diameter defining a central spring axis 34. The coil spring 26 has an unknotted upper end turn 72 disposed substantially in a plane P4 and an unknotted lower end turn 74 disposed substantially in a plane P6, planes P5 and P6 being substantially perpendicular to central spring axis 34. See FIG. 3B.

Figure 4:
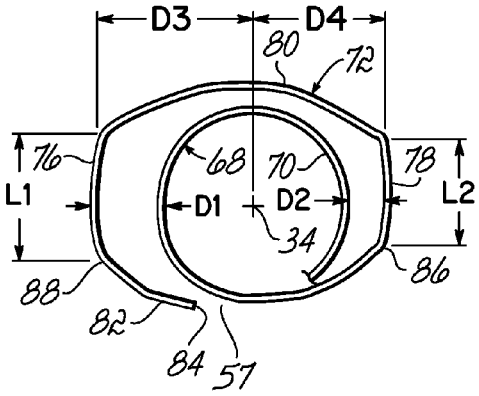
FIG. 4 is a view taken along the line 4-4 of FIG. 3 showing the unknotted upper end turn of the coil spring of FIG. 3.

Each of the unknotted end turns 72, 74 are identically formed so a description of one end turn will suffice for both. Each end turn 72, 74 is substantially U-shaped and has an arcuate long leg 76 and an arcuate short leg 78 joined together with an arcuate base web or connector 80. Each end turn 72, 74 also has an open side 57 opposite the connector 80. See FIGS. 4 and 5. Referring to FIG. 4 showing the upper end turn 72, the arcuate long leg 76 has a length L1 and the arcuate short leg 78 has a length L2 less than the length L1 of the long leg 76. Similarly, referring to FIG. 5 showing the lower end turn 74, the arcuate long leg 76 has a length L1 and the arcuate short leg 78 has a length L2 less than the length L1 of the long leg 76. In each end turn, the long leg 76 is located on the free unknotted end of the end turn 72, 74, respectively. Consequently, the long leg 76 of each end turn 72, 74 extends into a tail piece 82 having an end 84. The tail piece 82 of each end turn 72, 74 is bent inwardly towards the middle of the coil spring 26 in order to avoid puncturing the padding or upholstery which covers the spring core 12. Each of the end turns 72, 74 joins the central spiral portion 68 at a location indicated by number 86 and each of the long legs 76 joins the tail piece 82 at a location 88. The opposing end turns 72, 74 are inverted relative to each other to dispose the long and short legs of the upper end turn 72 of the coil spring 26 on the same side of the central spiral portion 68 of the coil spring 26 as the long and short legs, respectively, of the associated lower end turn 74. See FIG. 3.

As illustrated in FIGS. 4 and 5, in order to prevent what is known in the industry as "noise", the long leg 76 of each end turn 72, 74 is spaced laterally outward from the central spiral portion 68 of the coil spring 26 a distance D1. Similarly, the short leg 78 of each end turn 72, 74 is spaced laterally outward from the central spiral portion 68 of the coil spring 26 a distance D2 which is less than the distance D1. As is evident from the drawings, the long leg 76 of each end turn 72, 74 is spaced outwardly from the central spiral axis 34 a distance D3 and the short leg 78 of each end turn 72, 74 is spaced laterally outward from the central spiral axis 34 of the coil spring 26 a distance D4 which is less than the distance D3.

This version or embodiment of coil spring 26 of the present invention differs from the prior art "LFK" coil spring 40 in that it has a half less turn that the prior art "LFK" coil spring 40. More particularly, the prior art "LFK" coil spring 40 has 4.75 turns or revolutions as described above and the coil spring 26 of the present invention has 4.25 turns or revolutions. As shown in FIG. 3, the first and lowermost turn of coil spring 26 begins at free end 84 and terminates at one end of short leg 78 (at location 86). The end of each successive turn is shown in FIG. 3 with a mark 90. When comparing FIGS. 3 and 3A of this embodiment of the present invention to FIGS. 2, 2A and 2B of the prior art "LFK" coil spring 40, it is clear that this embodiment of coil spring 26 of the present invention eliminates a half a turn of wire. Therefore, the coil spring 26 of the present invention requires less material and is cheaper to manufacturer than the prior art coil spring 40.

Figure 3C:
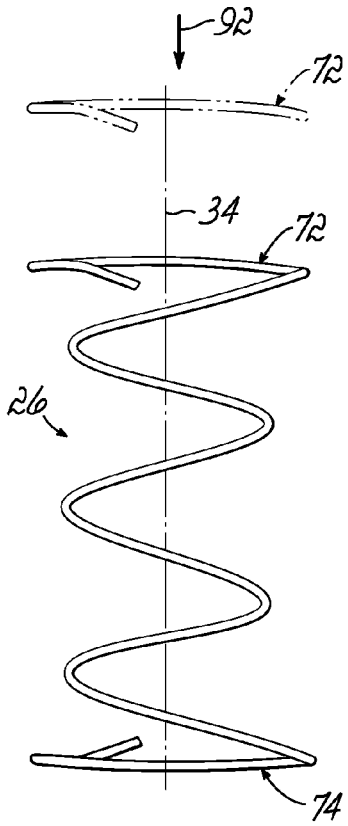
FIG. 3C is a side elevational view of the coil spring of FIG. 3 in a compressed condition.

As shown in FIG. 3C, when a downwardly directed load (see arrow 92) is placed on coil spring 26, the coil spring 26 does not lean in a lateral direction. FIGS. 3A and 3B illustrate the coil spring 26 at rest with no load placed thereon. In such a relaxed unloaded condition, the central spring axis 34 is vertical. FIG. 3C illustrates the coil spring 26 compressed or loaded in the direction of arrow 92 so that the upper end turn 72 of coil spring 26 moves from the position shown in dashed lines to the position shown in solid lines. In its compressed or loaded condition, the central spring axis 34 is still vertical rather than inclined like the prior art coil spring shown in FIG. 2C.

As shown in FIGS. 6 and 7, adjacent coil springs 26 are connected at their upper and lower end turns 72, 74, respectively by helical lacing wires 32. Other means of securing the end turns of adjacent coil springs are within the contemplation of the present invention. Referring to FIG. 6, the helical lacing wires 32 attach the long leg 76 of upper end turn 72 with a corresponding short leg 78 of an adjacent upper end turn 72 of an adjacent coil spring 26. As best seen in FIG. 6, the helical lacing wire 32 encircles the long leg 76 four times but only encircles the short leg 78 of the adjacent end turn 72 three times. Such an assembly prevents an offset or axial misalignment of the springs during formation of the spring core 12 and enables the manufacturer to create a rectangular spring core 12. The same is true with adjacent lower end turns 74 of coil springs 26.

FIG. 6 illustrates the arrangement of the coil springs 26 in rows 28 and columns 30, 31. The coil springs 26 are arranged in side-by-side rows 28 joined to each other at the end turns 72, 74 with helical lacing wires 32. The coil springs 26 are all identically formed and identically oriented (except for those in column 31) so that either the long or short legs 76, 78 or connectors 80 of the end turns 72, 74 of the outermost coil springs 26 may be clipped or otherwise secured to the border wire 36. In the endmost column 31 of coil spring 26, the coil springs 26 are rotated 180 degrees relative to the other coil springs 26 so that the connectors 80 of the end turns 72, 74 of coil springs 26 may be clipped or otherwise secured to the border wire 36. This rotation of the coil springs 26 prevents the open side 57 of the end turns 72, 74 from facing the border wire 36.

The wire used to form the coil spring 26 is a high tensile strength wire having a tensile strength of at least 290,000 psi and preferably between 290,000 and 320,000 psi. The nature and resiliency of this high tensile wire enables the coil springs 26 to be manufactured with half a turn less and therefore with less material when compared to prior art coil springs like the one shown in FIG. 2.

Figure 12:
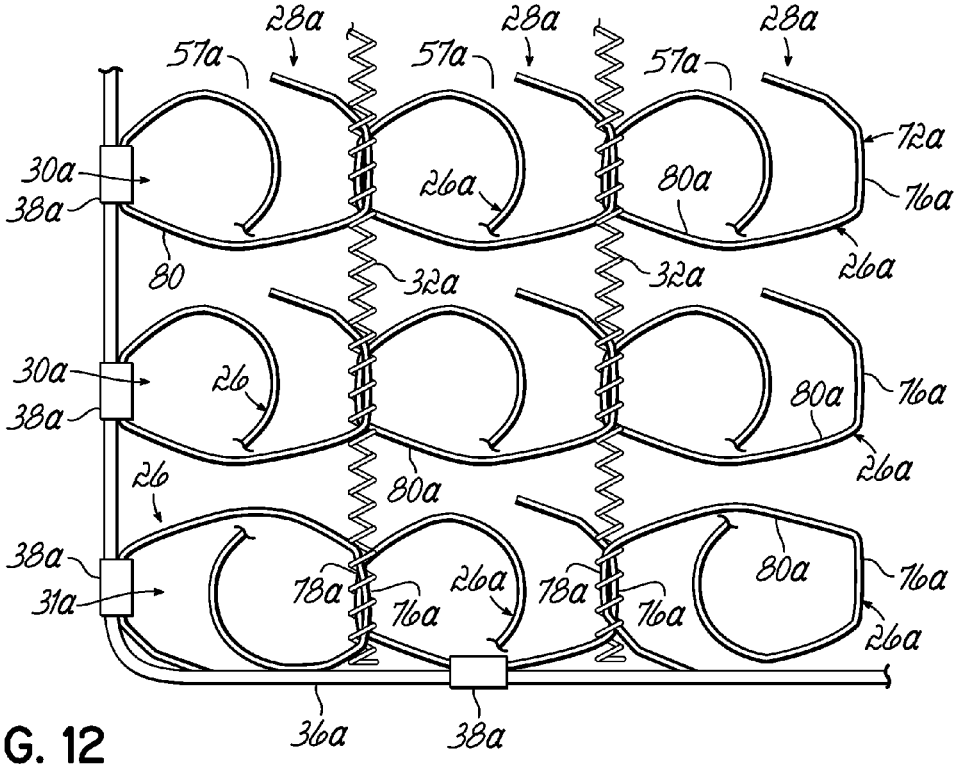
FIG. 12 is an enlarged top view of the portion of the product illustrated in dashed lines in FIG. 8.
Figure 8:
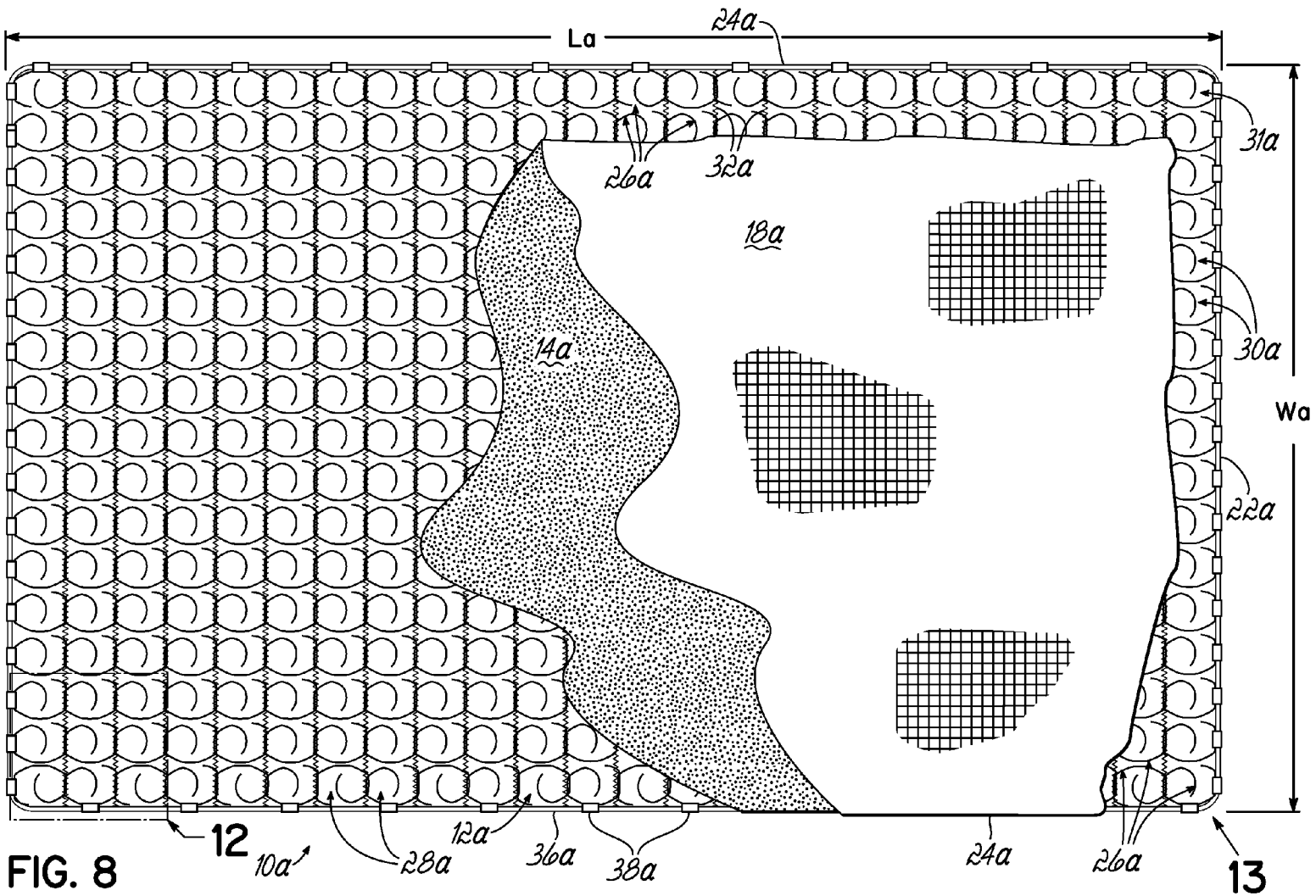
FIG. 8 is a top view of a bedding or seating product having a spring core made in accordance with another aspect of the present invention.
Figure 13:
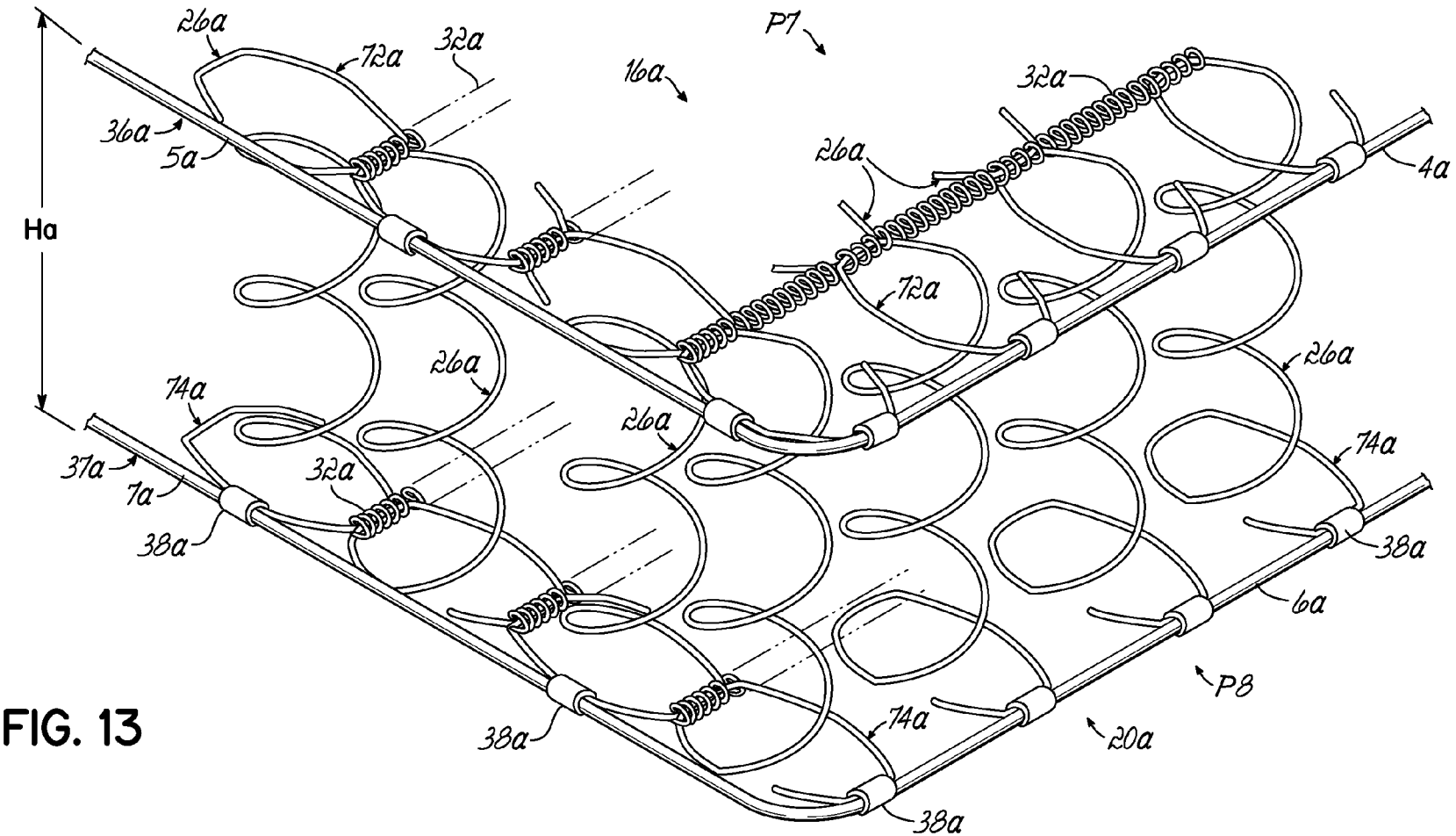
FIG. 13 is a perspective view of a portion of the spring core of FIG. 8 looking from the direction of arrow 13 of FIG. 8.
Figure 14:
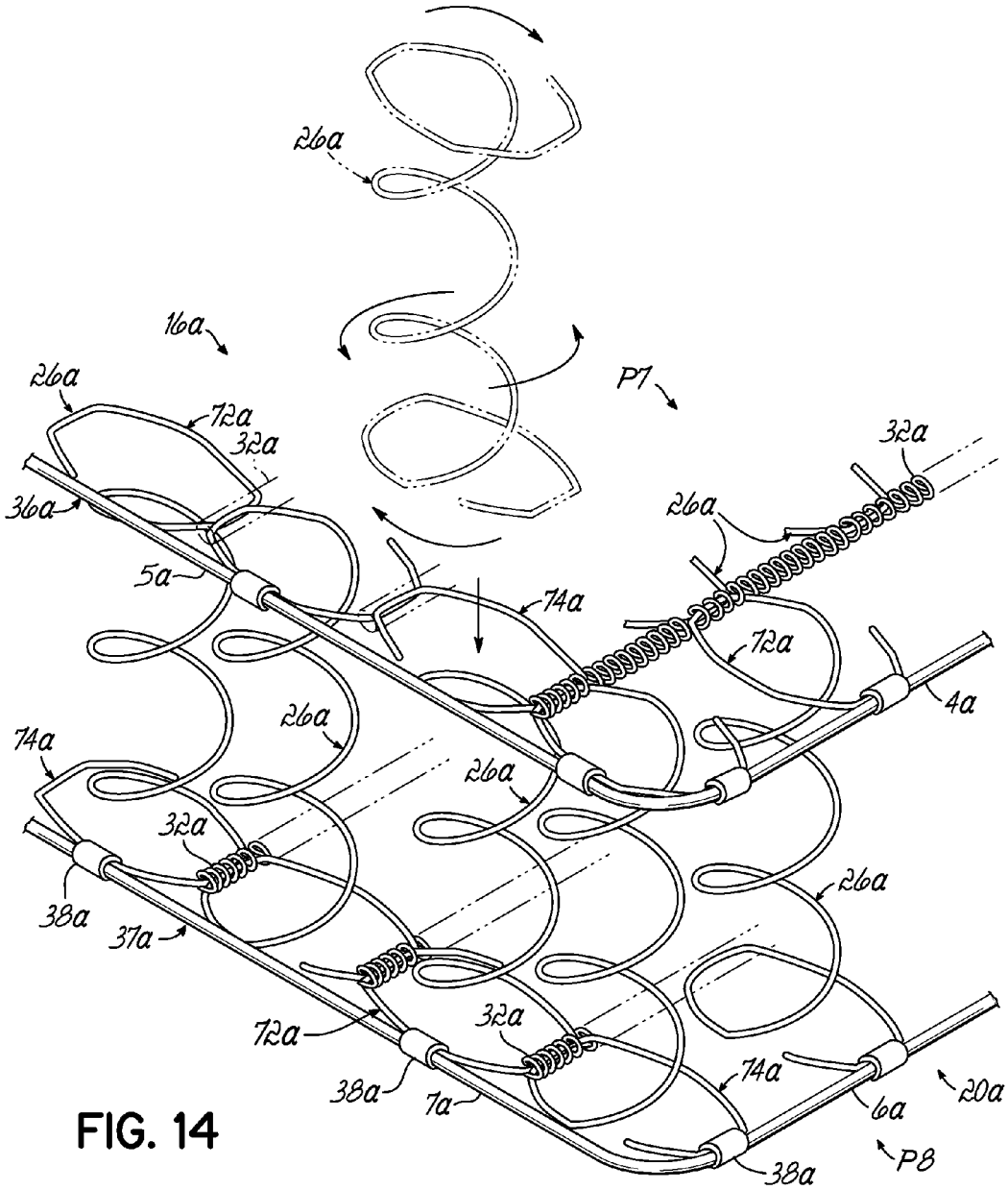
FIG. 14 is a perspective view of a portion of the spring core of FIG. 8 looking from the direction of arrow 13 of FIG. 8 and showing the rotation and flip of one of the outermost coil springs.

An alternative embodiment of the present invention is illustrated in FIGS. 8-14. In this embodiment, like parts will be described with like numbers to those described above but with an "a" designation after the number. FIG. 8 illustrates a two-sided mattress 10*a* made in accordance with another aspect of the present invention. The mattress 10*a* comprises a spring core or spring assembly 12*a* comprising a generally rectangular upper border wire 36*a*, a generally rectangular lower border wire 37*a* and a plurality of innerconnected coil springs 26*a* held together with helical lacing wires 32*a*, the peripheral or outermost coil springs 26*a* being secured or clipped with clips 38*a* to the upper and lower border wires 36*a*, 37*a* in a manner described below. As seen in FIGS. 13 and 14, the upper border wire 36*a* has opposed end portions 4*a* and opposed side portions 5*a*. Lower border wire 37*a* has opposed end portions 6*a* and opposed side portions 7*a*. The spring core 12*a* has a generally planar upper surface 16*a* and a generally planar lower surface 20*a*, padding 14*a* covering both the upper and lower surfaces 16*a*, 20*a* of the mattress 10*a* (see FIG. 13) and an upholstered covering 18*a* surrounding the spring core 12*a* and padding 14*a*.

As shown in FIG. 13, the generally planar upper surface 16*a* of the product 10*a* including the upper border wire 36*c* is located generally in a horizontal plane P7. Similarly, the generally planar lower surface 20*a* of the product 10*a* including the lower border wire 37*a* is located generally in a horizontal plane P8. The distance between the upper and lower surfaces 16*a*, 20*a* of the product 10*a* is defined as the height Ha of the product 10*a*. See FIG. 13. Referring to FIG. 8, the product 10*a* has a longitudinal dimension or length La defined as the distance between opposed end surfaces 22*a* and a transverse dimension or width Wa defined as the distance between opposed side surfaces 24*a*. Although the length La of the product 10*a* is commonly greater than the width Wa of the product 10*a*, these dimensions may be equivalent, such as in a square product.

Figure 9:
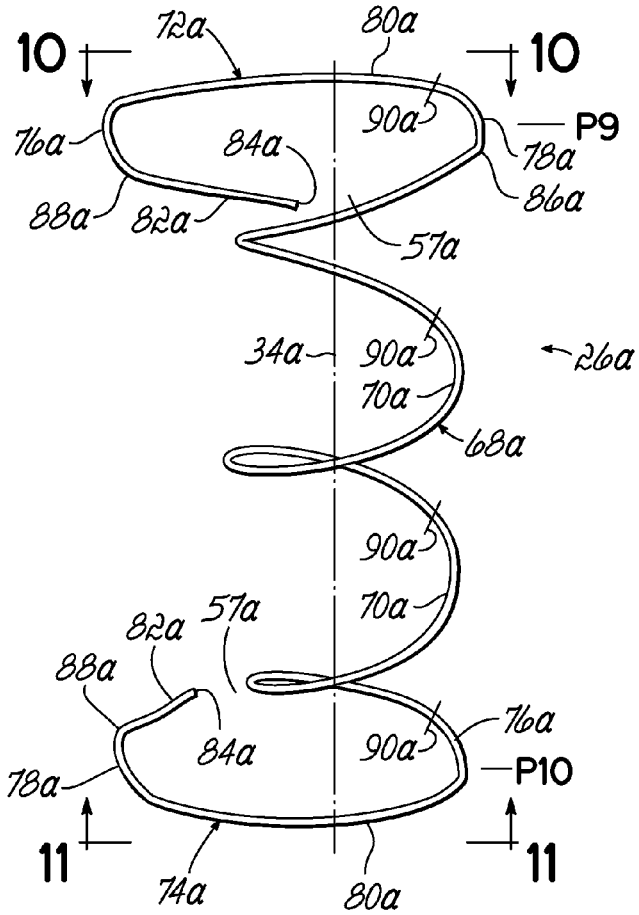
FIG. 9 is a perspective view of alternative embodiment of coil spring having unknotted end turns.
Figure 10:
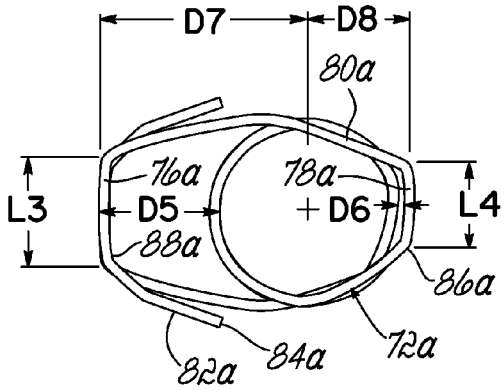
FIG. 10 is a top view of the coil spring of FIG. 9.
Figure 11:
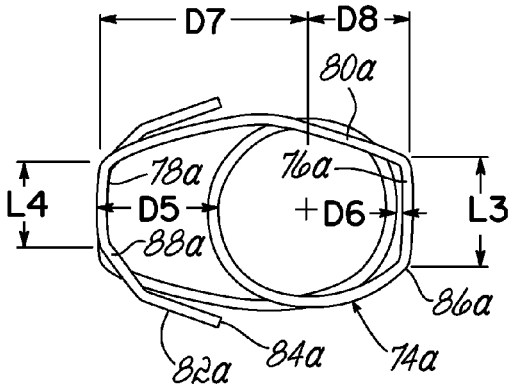
FIG. 11 is a bottom view of the coil spring of FIG. 9.

FIGS. 9, 10 and 11 illustrate another embodiment of coil spring 26*a* made in accordance with the present invention and incorporated into the product 10*a* shown in FIG. 8. FIGS. 9, 10 and 11 illustrate coil spring 26*a* in a relaxed or uncompressed condition. However, when loaded or compressed, coil spring 26*a* behaves like coil spring 26 as shown in FIG. 3 in that its axis 34*a* remains substantially vertical and the coil spring 26*a* does not lean. All of the coil springs 26*a* used to make product 10*a* are identical and shown in detail in FIGS. 9, 10 and 11. The coil springs 26*a* are of the same hand; the wire extends in a clockwise direction as the wire moves down the coil spring (from top to bottom). See FIG. 8.

Coil spring 26*a* is made of a single piece of wire having a central spiral portion 68*a* made up of a plurality of consecutive helical loops or revolutions 70*a* of the same diameter defining a central spring axis 34*a*. The coil spring 26*a* has an unknotted upper end turn 72*a* disposed substantially in a plane P9 and an unknotted lower end turn 74*a* disposed substantially in a plane P10, planes P9 and P10 being substantially perpendicular to central spring axis 34*a*. See FIG. 9.

In this embodiment of coil spring 26*a*, each of the unknotted end turns 72*a*, 74*a* are not identically formed. Each end turn 72*a*, 74*a* is substantially U-shaped and has an arcuate long leg 76*a* and an arcuate short leg 78*a* joined together with an arcuate base web or connector 80*a*. Each end turn 72*a*, 74*a* also has an open side 57*a* opposite the connector 80*a*. Referring to FIG. 10, the upper end turn 72*a* has an arcuate long leg 76*a* having a length L3 and an arcuate short leg 78*a* having a length L4 less than the length L3 of the long leg 76*a*. Similarly, referring to FIG. 11, the lower end turn 74*a* has an arcuate long leg 76*a* having a length L3 and the arcuate short leg 78*a* having a length L4 less than the length L3 of the long leg 76*a*. As shown in FIG. 10, in the upper end turn 72*a*, the long leg 76*a* is located on the free unknotted end of the end turn 72*a*. Consequently, the long leg 76*a* of the upper end turn 72*a* extends into a tail piece 82*a* having an end 84*a*.

However, as shown in FIG. 11, in the lower end turn 74*a*, the short leg 78*a* is located on the free unknotted end of the end turn 74*a*. Consequently, the short leg 78*a* of the lower end turn 74*a* extends into a tail piece 82*a* having an end 84*a*. The tail piece 82*a* of each end turn 72*a*, 74*a* is bent inwardly towards the middle of the coil spring 26*a* in order to avoid puncturing the padding or upholstery which covers the spring core 12*a*. Each of the end turns 72*a*, 74*a* joins the central spiral portion 68*a* at a location indicated by number 86*a* and the long leg 76*a* of the upper end turn 72*a* and the short leg 78*a* of the lower end turn 74*a* joins the tail piece 82*a* at a location 88*a*. In this embodiment of the present invention, the long and short legs 76*a*, 78*a* of the upper end turn 72*a* of the coil spring 26*a* are on opposite sides of the central spiral portion 68*a* of the coil spring 26*a* when compared to the long and short legs 76*a*, 78*a*, respectively, of the associated lower end turn 74*a*. However, the legs 76*a*, 78*a* extending into the free open ends of the end turns 72*a*, 74*a*, respectively, are on the same side of the central spiral portion 68*a* of the coil spring 26*a*. See FIGS. 10 and 11.

As illustrated in FIGS. 10 and 11, in order to prevent what is known in the industry as "noise", the long leg 76*a* of the upper end turn 72*a* is spaced laterally outward from the central spiral portion 68*a* of the coil spring 26*a* a distance D5. Similarly, the short leg 78*a* of upper end turn 72*a* is spaced laterally outward from the central spiral portion 68*a* of the coil spring 26*a* a distance D6, less than the distance D5. It is reversed on the lower end turn 74*a* of coil spring 26*a*. The short leg 78*a* of the lower end turn 74*a* is spaced laterally outward from the central spiral portion 68*a* of the coil spring 26*a* a distance D5. Similarly, the long leg 76*a* of lower end turn 74*a* is spaced laterally outward from the central spiral portion 68*a* of the coil spring 26*a* a distance D6, less than the distance D5. As is evident from the drawings, the long leg 76*a* of end turn 72*a* is spaced outwardly from the central spiral axis 34*a* a distance D7 and the short leg 78*a* of end turn 72*a* is spaced laterally outward from the central spiral axis 34 of the coil spring 26*a* a distance D8 which is less than the distance D7. It is opposite on the lower end turn 74*a*. See FIG. 11. The short leg 78*a* of end turn 74*a* is spaced outwardly from the central spiral axis 34*a* a distance D7 and the long leg 76*a* of end turn 74*a* is spaced laterally outward from the central spiral axis 34*a* of the coil spring 26*a* a distance D7 which is less than the distance D8. In both end turns 72*a*, 74*a*, the distance D7 is greater than twice the distance D8 and the distance D5 is greater than twice the distance D6.

This version or embodiment of coil spring 26*a* of the present invention differs from the prior art "LFK" coil spring 40 in that it has a half less turn that the prior art "LFK" coil spring 40. More particularly, the prior art "LFK" coil spring 40 has 4.75 turns or revolutions as described above and the coil spring 26*a* of the present invention has 4.25 turns or revolutions. As shown in FIG. 9, the first and lowermost turn of coil spring 26*a* begins at free end 84*a* and terminates at one end of short leg 78*a* (at location 86*a*). The end of each successive turn is shown in FIG. 9 with a mark 90*a*. When comparing FIGS. 9, 10 and 11 of this embodiment of the present invention to FIGS. 2, 2A and 2B of the prior art "LFK" coil spring, it is clear that this embodiment of the present invention, eliminates a half a turn. Therefore, the coil spring 26*a* of the present invention requires less material and is cheaper to manufacturer than the prior art coil spring 40.

The wire used to form the coil spring 26*a* is a high tensile strength wire having a tensile strength of at least 290,000 psi and preferably between 290,000 and 320,000 psi. The nature and resiliency of this high tensile wire enables the coil springs 26 to be manufactured with half a turn less and therefore with less material when compared to prior art coil springs like the one shown in FIG. 2.

As shown in FIGS. 12 and 13, adjacent coil springs 26*a* are connected at their upper and lower end turns 72*a*, 74*a*, respectively by helical lacing wires 32*a*. Other means of securing the end turns of adjacent coil springs are within the contemplation of the present invention. Referring to FIG. 13, the helical lacing wires 32*a* attach the long leg 76*a* of upper end turn 72*a* with a corresponding short leg 78*a* of an adjacent end turn 72*a* of an adjacent coil spring 26*a*. As best seen in FIG. 12, the helical lacing wire 32*a* encircles the long leg 76*a* four times, but only encircles the short leg 78*a* of the adjacent end turn 72*a* three times. Such an assembly prevents an offset or axial misalignment of the springs during formation of the spring core 12*a* and enables the manufacturer to create a rectangular spring core 12*a*. The same is true with adjacent lower end turns 74*a* of coil springs 26*a*.

FIG. 12 illustrates the arrangement of the coil springs 26*a* in transversely extending rows 28*a* and longitudinally extending columns 30*a*, 31*a*. The coil springs 26*a* are arranged in side-by-side rows 28*a* joined to each other at the end turns 72*a*, 74*a* with helical lacing wires 32*a*. The coil springs 26*a* are all identically formed and identically oriented (except for outermost columns 31*a*). The coil springs are specifically oriented so that a long leg 76*a* of an end turn 72*a*, 74*a* abuts a short leg 78*a* of an end turn 72*a*, 74*a* for alignment purposes. In order to accomplish this, along each of the outermost columns 31*a* of coil springs 26*a*, every other coil spring 26*a* must have the open side 57*a* of one of its end turns 72*a*, 74*a* abutting one of the border wires 36*a*, thereby preventing that particular end turn to be clipped or otherwise secured to one of the two border wires 36*a*. Consequently, along the outermost columns 30*a*' of the spring core 12*a*, every other coil spring 26*a* has its upper end turn 72*a* clipped or otherwise secured to the upper border wire 36*a* and its lower end turn 74*a* not clipped or secured to lower border wire. Similarly, every other coil spring 26*a* has its lower end turn 74*a* clipped or otherwise secured to the lower border wire 36*a* and not its upper end turn 72*a* clipped or secured to upper border wire. See FIGS. 12 and 13.

As shown in FIG. 14, in the endmost columns 31*a* of coil springs 26*a*, every other coil spring 26*a* is rotated 180 degrees and flipped so that one of the connectors 80*a* of one of the end turns 72*a*, 74*a* may be clipped or otherwise secured to one of the border wires 36*a*. This rotation and flip of the coil springs 26*a* is necessary so that a short leg 78*a* abuts a long leg 76*a* of abutting coil springs 26*a* throughout the spring core 12*a*.

Figure 15:
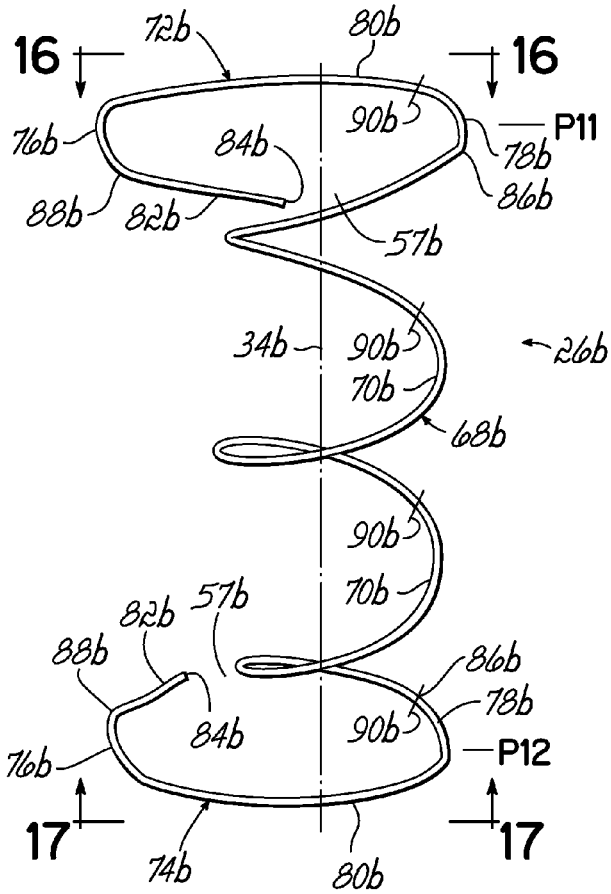
FIG. 15 is a perspective view of alternative embodiment of coil spring having unknotted end turns.
Figure 16:
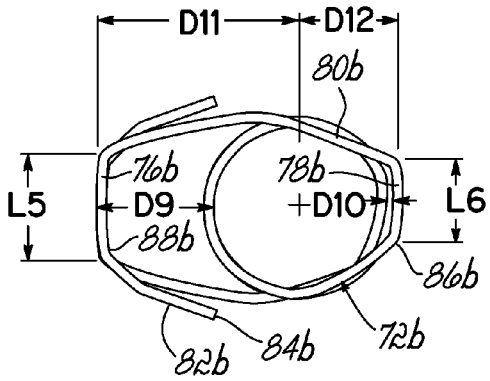
FIG. 16 is a top view of the coil spring of FIG. 15.
Figure 17:
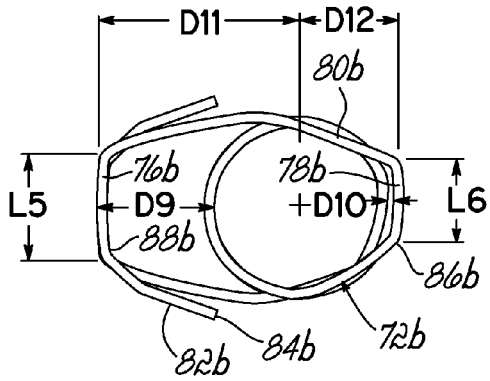
FIG. 17 is a bottom view of the coil spring of FIG. 15.

FIGS. 15, 16 and 17 illustrate another embodiment of coil spring 26*b* made in accordance with the present invention which may be incorporated into a product like product 10 shown in FIG. 1. FIGS. 15, 16 and 17 illustrate coil spring 26*b* in a relaxed or uncompressed condition. However, when loaded or compressed, coil spring 26*b* behaves like coil spring 26 as shown in FIG. 3 in that its axis 34*b* remains substantially vertical and the coil spring 26*b* does not lean. Coil spring 26*b* is like coil spring 26 shown in FIGS. 3, 3A, 3B, 3C, 4 and 5 but has larger end turns or heads 72*b*, 74*b* than the end turns 72, 74 of coil spring 26.

Coil spring 26*b* is made of a single piece of wire having a central spiral portion 68*b* made up of a plurality of consecutive helical loops or revolutions 70*b* of the same diameter defining a central spring axis 34*b*. The coil spring 26*b* has an unknotted upper end turn 72*b* disposed substantially in a plane P11 and an unknotted lower end turn 74*b* disposed substantially in a plane P12, planes P11 and P12 being substantially perpendicular to central spring axis 34*b*. See FIG. 15.

In this embodiment of coil spring 26*b*, each of the unknotted end turns 72*b*, 74*b* are identically formed. Each end turn 72*b*, 74*b* is substantially U-shaped and has an arcuate long leg 76*b* and an arcuate short leg 78*b* joined together with an arcuate base web or connector 80*b*. Each end turn 72*b*, 74*b* also has an open side 57*b* opposite the connector 80*b*. Referring to FIG. 16 showing the upper end turn 72*b*, the arcuate long leg 76*b* has a length L5 and the arcuate short leg 78*b* has a length L6 less than the length L5 of the long leg 76*b*. Similarly, referring to FIG. 17 showing the lower end turn 74*b*, the arcuate long leg 76*b* has a length L5 and the arcuate short leg 78*b* has a length L6 less than the length L5 of the long leg 76*b*. In each end turn 72*b*, 74*b*, the long leg 76*b* is located on the free unknotted end of the end turn, respectively. Consequently, the long leg 76*b* of each end turn 72*b*, 74*b* extends into a tail piece 82*b* having an end 84*b*. The tail piece or portion 82*b* of each end turn 72*b*, 74*b* is bent inwardly towards the middle of the coil spring 26*b* in order to avoid puncturing the padding or upholstery which covers the spring core. Each of the end turns 72*b*, 74*b* joins the central spiral portion 68*b* at a location indicated by number 86*b* and each of the long legs 76*b* joins the tail piece 82*b* at a location 88*b*. The opposing end turns 72*b*, 74*b* are inverted relative to each other to dispose the long and short legs of the upper end turn 72*b* of the coil spring 26*b* on the same side of the central spiral portion 68*b* of the coil spring 26*b* as the long and short legs, respectively, of the associated lower end turn 74*b*. See FIG. 15.

As illustrated in FIGS. 16 and 17, in order to prevent what is known in the industry as "noise", the long leg 76*b* of the upper end turn 72*b* is spaced laterally outward from the central spiral portion 68*b* of the coil spring 26*b* a distance D9. Similarly, the short leg 78*b* of upper end turn 72*b* is spaced laterally outward from the central spiral portion 68*b* of the coil spring 26*b* a distance D10, less than the distance D9. It is the same on the lower end turn 74*b* of coil spring 26*b*. The long leg 76*b* of lower end turn 74*b* is spaced laterally outward from the central spiral portion 68*b* of the coil spring 26*b* a distance D9, more than twice the distance D10. As shown in FIGS. 16 and 17, the long leg 76*b* of each end turn 72*b*, 74*b* is spaced outwardly from the central spiral axis 34*b* a distance D11 and the short leg 78*b* of each end turn 72*a*, 74*b* is spaced laterally outward from the central spiral axis 34*b* of the coil spring 26*b* a distance D12 which is less than the distance D11. In both end turns 72*b*, 74*b*, the distance D11 is greater than twice the distance D12 and the distance D9 is greater than twice the distance D10.

Figure 18:
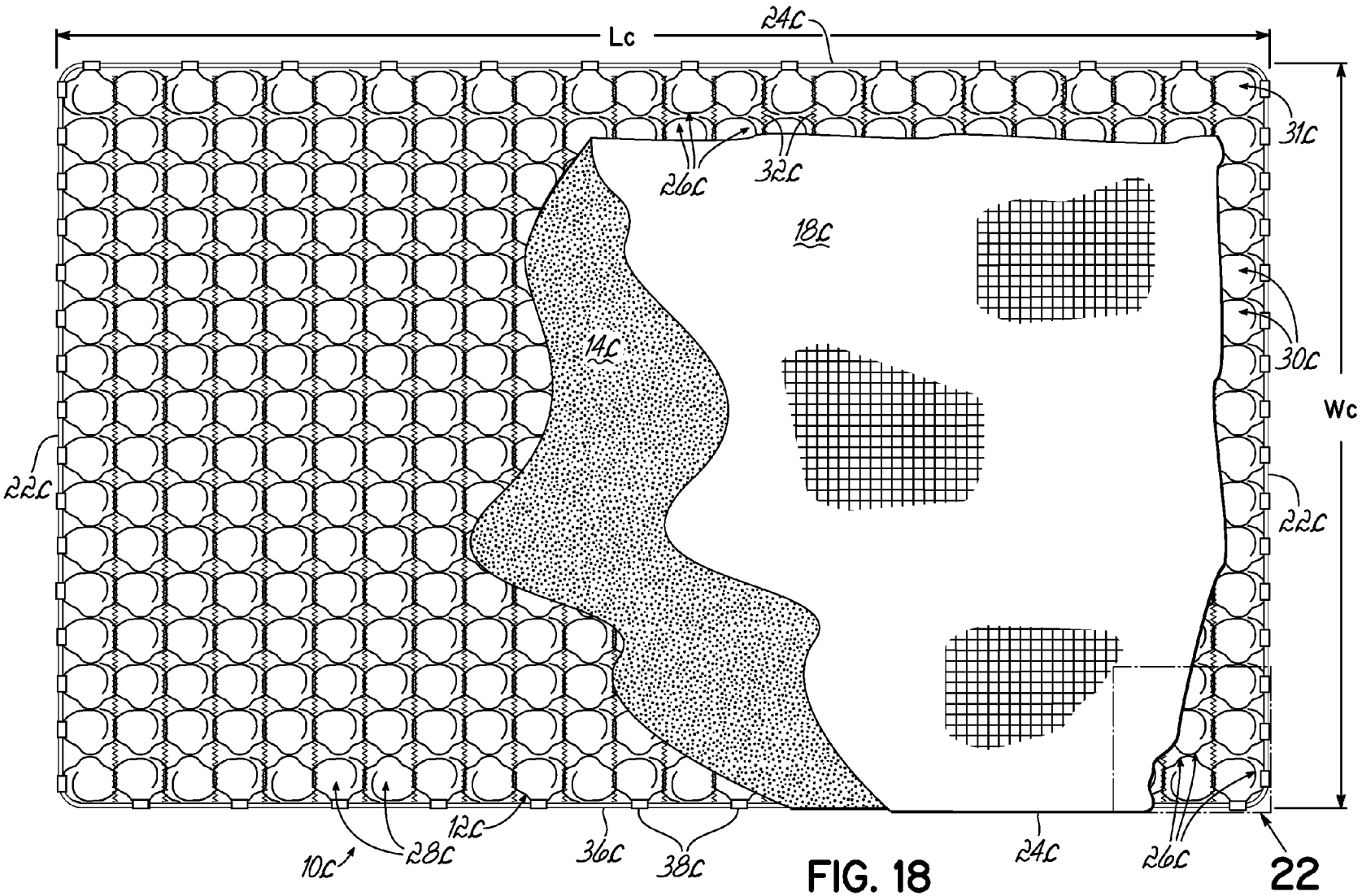
FIG. 18 is a top view of a bedding or seating product having a spring core made in accordance with another aspect of the present invention.
Figure 21:
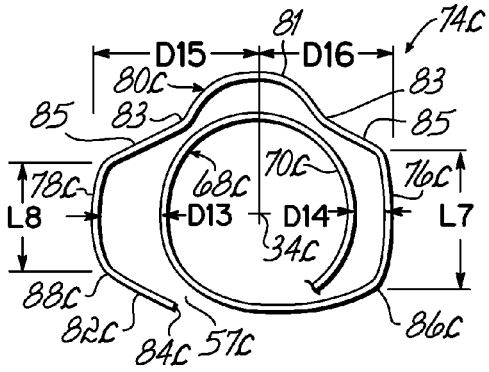
FIG. 21 is a bottom view of the coil spring of FIG. 19.
Figure 22:
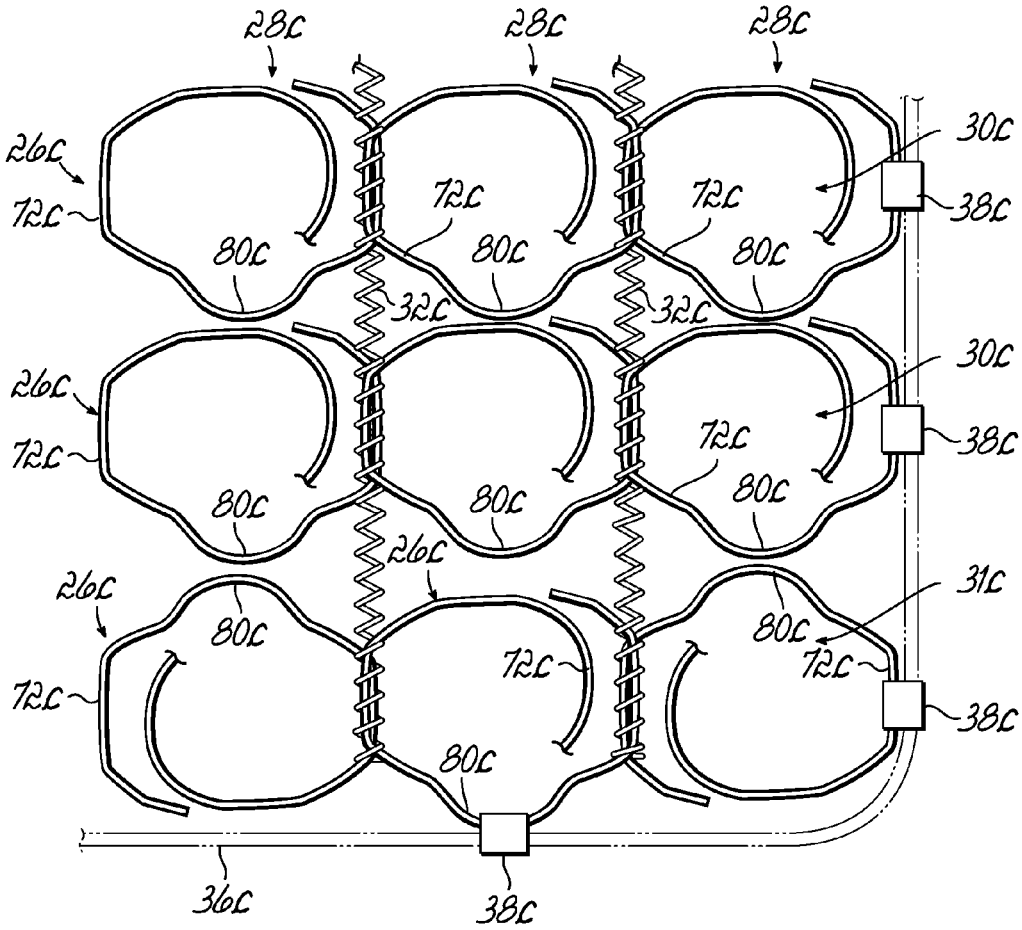
FIG. 22 is an enlarged top view of the portion of the product illustrated in dashed lines in FIG. 18.
Figure 23:
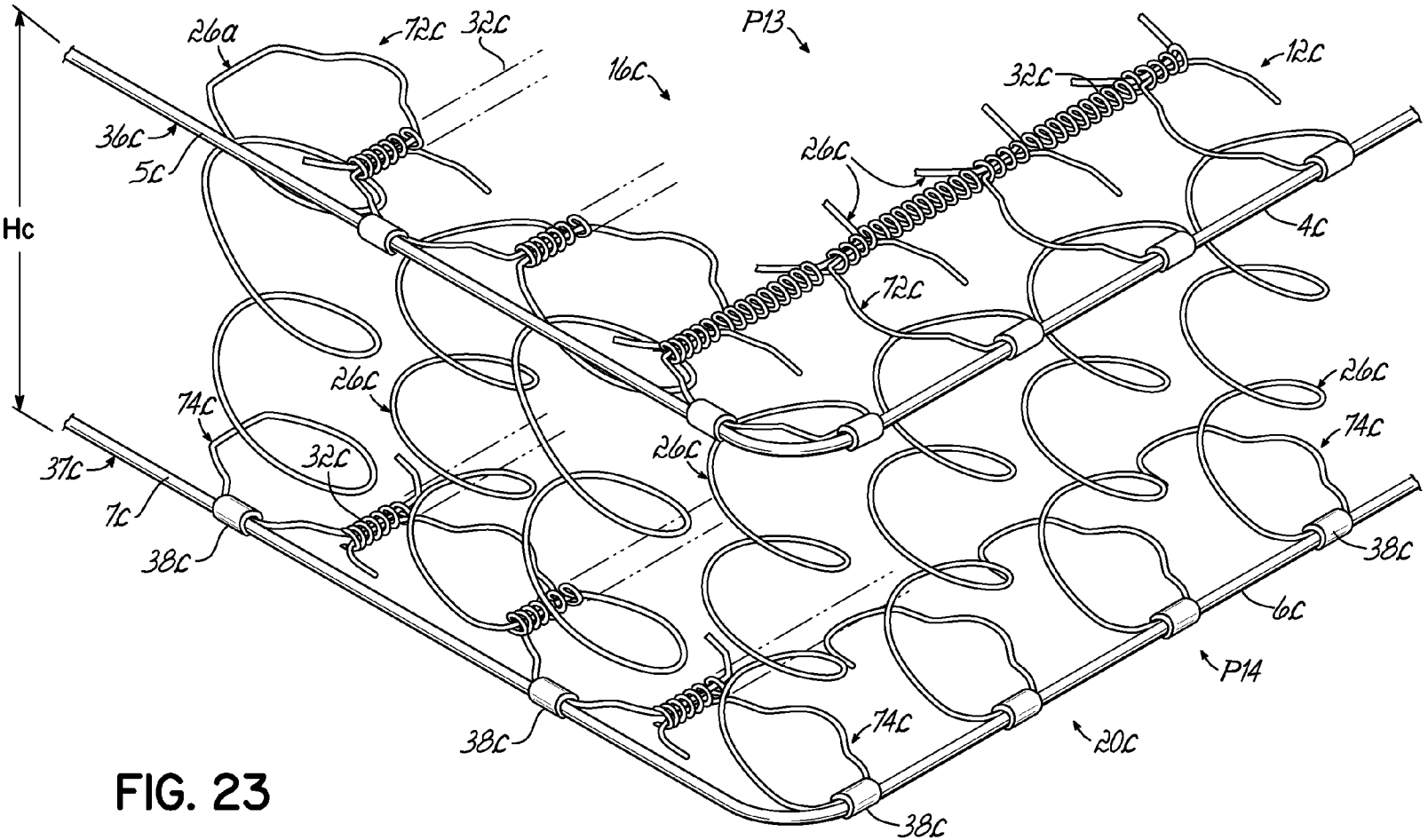
FIG. 23 is a perspective view of a portion of the spring core of FIG. 18 looking from the direction of arrow 22 of FIG. 18.
Figure 24:
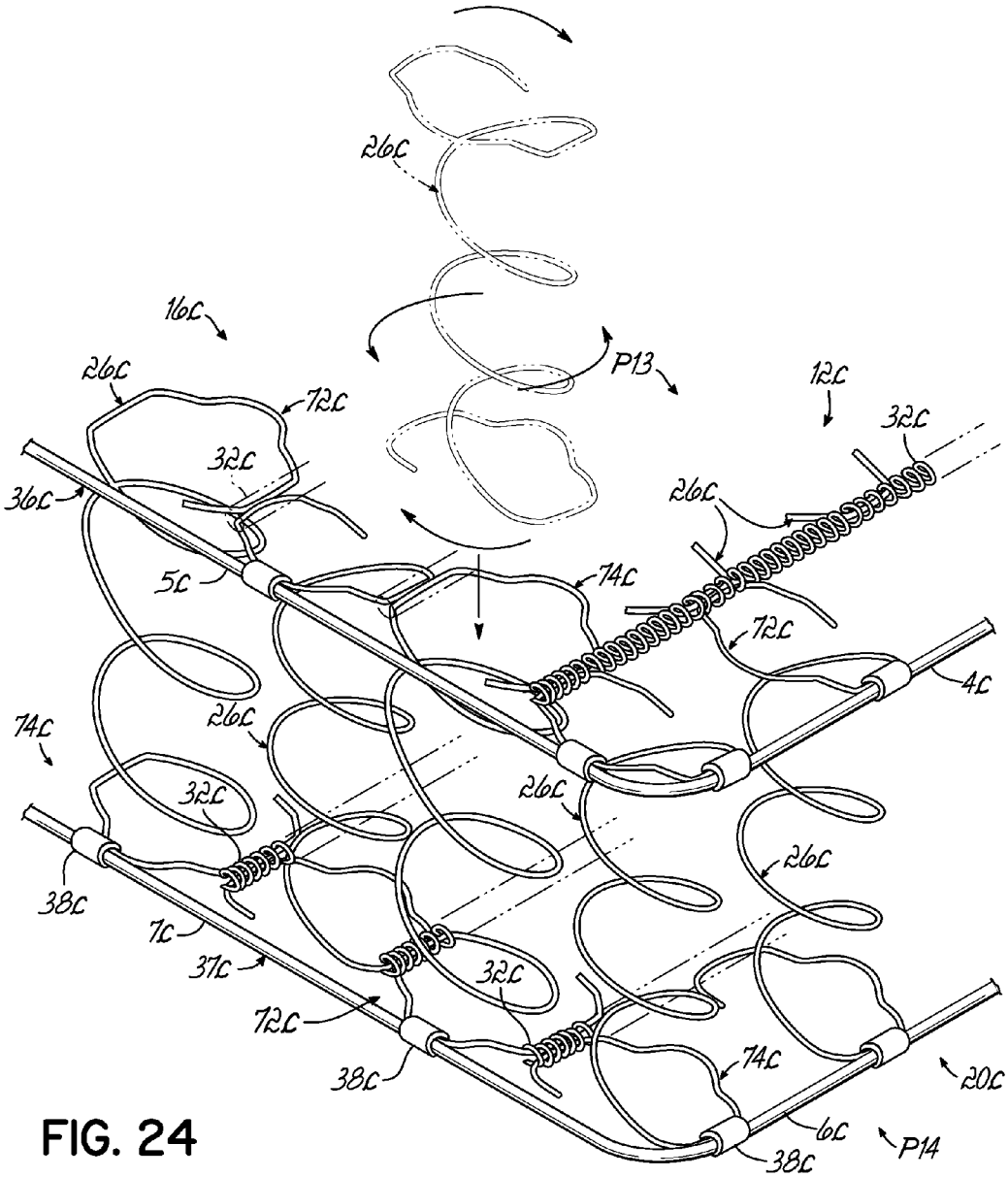
FIG. 24 is a perspective view of a portion of the spring core of FIG. 18 looking from the direction of arrow 22 of FIG. 18 and showing the rotation and flip of one of the coil springs of one of the outermost columns.

FIGS. 18-24 illustrate an alternative embodiment of the present invention. In this embodiment, like parts will be described with like numbers to those described above but with a "c" designation after the number. FIGS. 18, 23 and 24 illustrate a two-sided mattress 10*c* made in accordance with another aspect of the present invention. The mattress 10*c* comprises a spring core or spring assembly 12*c* comprising a generally rectangular upper border wire 36*c*, a generally rectangular lower border wire 37*c* and a plurality of interconnected coil springs 26*c* held together with helical lacing wires 32*c*, outmost coil springs 26*c* being secured or clipped with clips 38*c* to the upper and lower border wires 36*c*, 37*c* in a manner described below. As seen in FIGS. 23 and 24, the upper border wire 36*c* has opposed end portions 4*c* and opposed side portions 5*c*. Lower border wire 37*c* has opposed end portions 6*c* and opposed side portions 7*c*. The spring core 12*c* has a generally planar upper surface 16*c* and a generally planar lower surface 20*c*, padding 14*c* covering the upper and lower surfaces 16*c*, 20*c* of the mattress 10*c* (see FIG. 18) and an upholstered covering 18*c* surrounding the spring core 12*c* and padding 14*c*.

As shown in FIG. 23, the generally planar upper surface 16*c* of the product 10*c*, including the upper border wire 36*c*, is located generally in a horizontal plane P13. Similarly, the generally planar lower surface 20*c* of the product 10*c* including the lower border wire 37*c* is located generally in a horizontal plane P14. The distance between the upper and lower surfaces 16*c*, 20*c* of the product 10*c* is defined as the height Hc of the product 10*c*. See FIG. 23. Referring to FIG. 18, the product 10*c* has a longitudinal dimension or length Lc defined as the distance between opposed end surfaces 22*c* and a transverse dimension or width Wc defined as the distance between opposed side surfaces 24*c*. Although the length Lc of the product 10*c* is commonly greater than the width Wc of the product 10*c*, these dimensions may be equivalent, such as in a square product.

Figure 19:
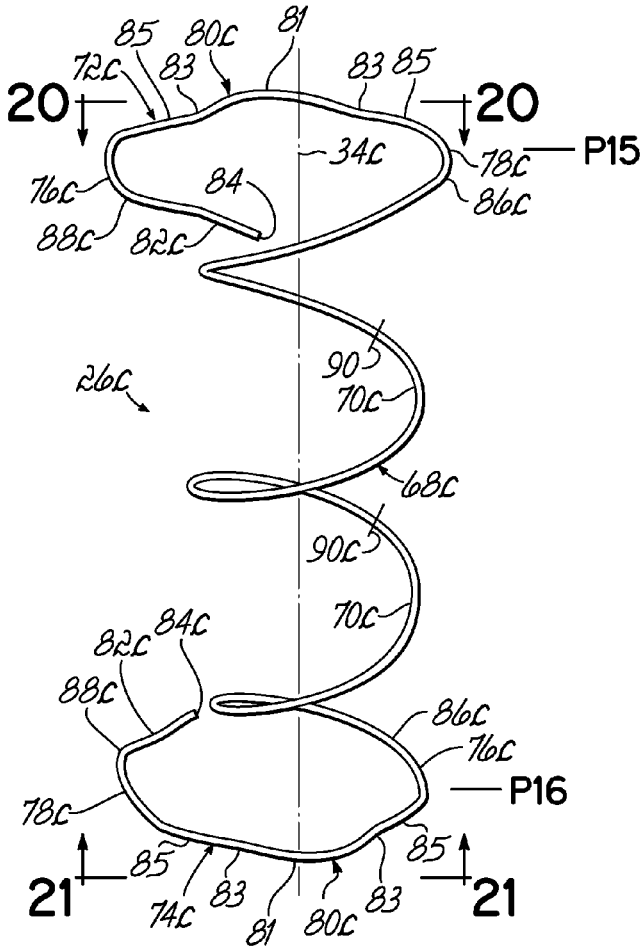
FIG. 19 is a perspective view of alternative embodiment of coil spring having unknotted end turns.
Figure 20:
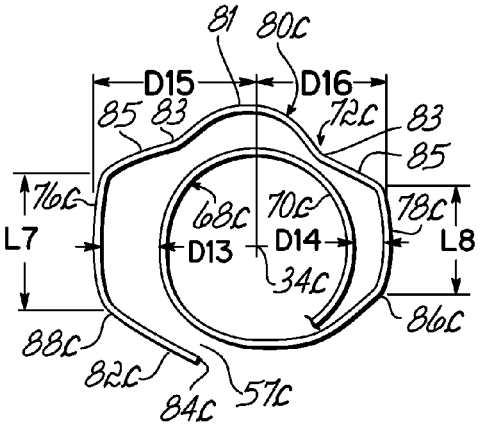
FIG. 20 is a top view of the coil spring of FIG. 19.

FIGS. 19, 20 and 21 illustrate coil spring 26*c* incorporated into the product 10*c* shown in FIG. 18. FIGS. 19, 20 and 21 illustrate coil spring 26*c* in a relaxed or uncompressed condition. However, when loaded or compressed, coil spring 26*c* is balanced and behaves like coil spring 26 as shown in FIG. 3 in that its axis 34*c* remains substantially vertical and the coil spring 26*c* does not lean. All of the coil springs 26*c* used to make product 10*c* are identical and shown in detail in FIGS. 19, 20 and 21. The coil springs 26*c* are of the same hand; the wire extends in a clockwise direction as the wire moves down the coil spring (from top to bottom). See FIGS. 18 and 19.

Coil spring 26*c* is made of a single piece of wire having a central spiral portion 68*c* made up of a plurality of consecutive helical loops or revolutions 70*c* of the same diameter defining a central spring axis 34*c*. The coil spring 26*c* has an unknotted upper end turn 72*c* disposed substantially in a horizontal plane P15 and an unknotted lower end turn 74*a* disposed substantially in a horizontal plane P16, planes P15 and P16 being substantially perpendicular to central spring axis 34*c*. See FIG. 19.

In coil spring 26*c*, unknotted end turns 72*c*, 74*c* are not identically formed. Each end turn 72*c*, 74*c* is substantially U-shaped and has an arcuate long leg 76*c* and an arcuate short leg 78*c* joined together with an arcuate base web or connector 80*c* having an arcuate bump 81. Each end turn 72*c*, 74*c* also has an open side 57*c* opposite the connector 80*c*. As shown in FIGS. 19-21, the arcuate connector 80*c* of each end turn 72*c*, 74*c* has an arcuate bump 81. The arcuate bump 81 extends from one location 83 to the other location 83 of arcuate connector 80*c* and is located between end portions 85 of the arcuate connector 80*c*. The bump 81 is configured to receive and retain a clip 38*c* for securing or clipping one of the end turns of coil spring 26*c* to one of the border wires 36*c*, 37*c*, thereby spacing coil spring 26*c* away from the upper and lower border wires 36*c*, 37*c*, respectively. See FIG. 22.

Referring to FIG. 20, the upper end turn 72*c* has an arcuate long leg 76*c* having a length L7 and an arcuate short leg 78*c* having a length L8 less than the length L7 of the long leg 76*c*. Similarly, referring to FIG. 21, the lower end turn 74*c* has an arcuate long leg 76*c* having a length L7 and an arcuate short leg 78*c* having a length L8 less than the length L7 of the long leg 76*c*. As shown in FIG. 20, in the upper end turn 72*c*, the long leg 76*c* is located on the free unknotted end of the end turn 72*c*. Consequently, the long leg 76*c* of the upper end turn 72*c* extends into a tail piece 82*c* having an end 84*c*.

However, as shown in FIG. 21, in the lower end turn 74*c*, the short leg 78*c* is located on the free unknotted end of the end turn 74*c*. Consequently, the short leg 78*c* of the lower end turn 74*c* extends into a tail piece 82*c* having an end 84*c*. The tail piece 82*c* of each end turn 72*c*, 74*c* is bent inwardly towards the middle of the coil spring 26*c* in order to avoid puncturing the padding or upholstery which covers the spring core 12*c*. Each of the end turns 72*c*, 74*c* joins the central spiral portion 68*c* at a location indicated by number 86*c* and the long leg 76*c* of the upper end turn 72*c* and the short leg 78*c* of the lower end turn 74*c* joins the tail piece 82*c* at a location 88*c*. In this embodiment, the long and short legs 76*c*, 78*c* of the upper end turn 72*c* of the coil spring 26*c* are on opposite sides of the central spiral portion 68*c* of the coil spring 26*c* when compared to the long and short legs 76*c*, 78*c*, respectively, of the associated lower end turn 74*c*. However, the legs 76*c*, 78*c* extending into the free open ends of the end turns 72*c*, 74*c*, respectively, are on the same side of the central spiral portion 68*c* of the coil spring 26*c*. See FIGS. 20 and 21. The arcuate connector of one of the end turns is on the opposite side of the central spring axis 34*c* than the connector of the other end turn.

As illustrated in FIGS. 20 and 21, in order to prevent what is known in the industry as "noise", the long leg 76*c* of the upper end turn 72*c* is spaced laterally outward from the central spiral portion 68*c* of the coil spring 26*c* a distance D13. Similarly, the short leg 78*c* of upper end turn 72*c* is spaced laterally outward from the central spiral portion 68*c* of the coil spring 26*c* a distance D14, less than the distance D13. It is reversed on the lower end turn 74*c* of coil spring 26*c*. The short leg 78*c* of the lower end turn 74*c* is spaced laterally outward from the central spiral portion 68*c* of the coil spring 26*c* a distance D13. Similarly, the long leg 76*c* of lower end turn 74*c* is spaced laterally outward from the central spiral portion 68*c* of the coil spring 26*c* a distance D14, less than the distance D13. As is evident from the drawings, the long leg 76*c* of upper end turn 72*c* is spaced outwardly from the central spiral axis 34*c* a distance D15 and the short leg 78*c* of upper end turn 72*c* is spaced laterally outward from the central spiral axis 34*c* of coil spring 26*c* a distance D16 which is less than the distance D15. It is opposite on the lower end turn 74*c*. See FIG. 21. The short leg 78*c* of lower end turn 74*c* is spaced outwardly from the central spiral axis 34*c* a distance D15 and the long leg 76*c* of lower end turn 74*c* is spaced laterally outward from the central spiral axis 34*c* of the coil spring 26*c* a distance D16 which is less than the distance D15. In both end turns 72*c*, 74*c*, the distance D15 is greater than the distance D16.

This version or embodiment of coil spring 26*c* differs from the prior art "LFK" coil spring 40 in that it has a half less turn that the prior art "LFK" coil spring 40. More particularly, the prior art "LFK" coil spring 40 has 4.75 turns or revolutions as described above and the coil spring 26*c* of the present invention has 4.25 turns or revolutions. As shown in FIG. 19, the first and lowermost turn of coil spring 26*c* begins at free end 84*c* and terminates at one end of short leg 78*c* (at location 86*a*). The end of each successive turn is shown in FIG. 19 with a mark 90*c*. When comparing FIGS. 19, 20 and 21 of this embodiment to FIGS. 2, 2A and 2B of the prior art "LFK" coil spring, it is clear that this embodiment of coil spring 26*c*, eliminates a half a turn of wire. Therefore, the coil spring 26*c* of the present invention requires less material and is cheaper to manufacturer than the prior art coil spring 40.

The wire used to form the coil spring 26*c* is a high tensile strength wire having a tensile strength of at least 290,000 psi and preferably between 290,000 and 320,000 psi. The nature and resiliency of this high tensile wire enables the coil springs 26*c* to be manufactured with half a turn less and therefore with less material when compared to prior art coil springs like the one shown in FIG. 2.

As shown in FIGS. 22 and 23, adjacent coil springs 26*c* are connected at their upper and lower end turns 72*c*, 74*c*, respectively by helical lacing wires 32*c*. Other means of securing the end turns of adjacent coil springs are within the contemplation of the present invention. Referring to FIG. 23, the helical lacing wires 32*c* attach the long leg 76*c* of upper end turn 72*c* with a corresponding short leg 78*c* of an adjacent end turn 72*c* of an adjacent coil spring 26*c*. As best seen in FIG. 22, the helical lacing wire 32*c* encircles the long leg 76*c* four times, but only encircles the short leg 78*c* of the adjacent end turn 72*c* three times. Such as assembly prevents an offset or axial misalignment of the springs during formation of the spring core 12*c* and enables the manufacturer to create a rectangular spring core 12*c*. The same is true with adjacent lower end turns 74*c* of coil springs 26*c*.

FIG. 22 illustrates the arrangement of the coil springs 26*c* in transversely extending rows 28*c* and longitudinally extending columns 30*c*, 31*c*. The coil springs 26*c* are arranged in side-by-side rows 28*c* joined to each other at the end turns 72*c*, 74*c* with helical lacing wires 32*c*. The coil springs 26*c* are all identically formed and identically oriented (except for outermost columns 31*c*). The coil springs are specifically oriented so that a long leg 76*c* of an end turn 72*c*, 74*c* abuts a short leg 78*c* of an end turn 72*c*, 74*c* for alignment purposes. In order to accomplish this, along each of the outermost columns 31*c* of coil springs 26*c*, every other coil spring 26*c* must have the open side 57*c* of one of its end turns 72*c*, 74*c* abutting one of the border wires 36*c*, thereby preventing that particular end turn to be clipped or otherwise secured to one of the two border wires 36*c*. Consequently, along the outermost columns 31*c* of the spring core 12*c*, every other coil spring 26*c* has its upper end turn 72*c* clipped or otherwise secured to the upper border wire 36*c* and its lower end turn 74*c* not clipped or secured to lower border wire 37*c*. Similarly, every other coil spring 26*c* has its lower end turn 74*c* clipped or otherwise secured to the lower border wire 37*c* and not its upper end turn 72*c* clipped or secured to upper border wire 36*c*. See FIGS. 22 and 23.

As shown in FIG. 24, along the endmost columns 31*c* of spring core 12*c*, every other coil spring 26*c* is rotated 180 degrees and flipped so that one of the connectors 80*c*, and in particular the bump 81 of connector 80*c*, of one of the end turns 72*c*, 74*c* may be clipped or otherwise secured to one of the border wires 36*c*, 37*c*. This rotation and flip of the coil springs 26*c* is necessary so that a short leg 78*c* abuts a long leg 76*c* of abutting coil springs 26*c* throughout the spring core 12*c*.

While various embodiments of the present invention have been illustrated and described in considerable detail, it is not the intention of the applicants to restrict or in any way limit the scope of the claims to such detail. Additional advantages and modifications will readily appear to those skilled in the art. The invention in its broader aspect is, therefore, not limited to the specific details, representative system, apparatus, and method, and illustrative examples shown and described. Accordingly, departures may be made from such details without departing from the spirit or scope of the applicant's general inventive concept. For example, the coil springs 26 may be manufactured with enlarged heads similar to those shown in coil springs 26*a*, but with the long legs of each end turn extending into the free unknotted ends of the end turns. Similarly, the coil springs 26*a* may be manufactured with smaller end turns like those shown in coil springs 26, but with the long leg of one end turn extending into a free end and the short leg of the other end turn extending into the free end.

We claim:

1. A bedding or seating product comprising:

a spring core made up of upper and lower border wires and a plurality of identically configured coil springs each made of a single piece of wire having a central spiral portion defining a central spring axis and terminating at opposing ends with unknotted upper and lower end turns disposed in planes substantially perpendicular to the spring axis, each of the upper and lower end turns being substantially U-shaped and having an arcuate long leg and an arcuate short leg joined by an arcuate connector having a bump, the arcuate long leg being at the free unknotted end of one of said end turns and the arcuate short leg being at the free unknotted end of the other of the end turns of the coil spring, the arcuate connector of one of the end turns being on the opposite side of the central spring axis than the connector of the other end turn of the coil spring, the coil springs being arranged in side-by-side rows and columns and being connected with each other at the upper and lower end turns by helical lacing wires, the coil springs being oriented the same direction in the spring core except the coil springs of the outermost columns of the spring core, every other one of the coil springs in each outermost column being flipped and rotated so that one of the connectors of one of the end turns may be clipped to one of the border wires;

padding overlaying an upper surface of the spring core; and an upholstered covering encasing the spring core and padding.

2. A bedding or seating product comprising:

a spring core made up of upper and lower border wires and a plurality of identically configured coil springs each made of a single piece of wire having a central spiral portion defining a central spring axis and terminating at opposing ends with unknotted upper and lower end turns disposed in planes substantially perpendicular to the spring axis, each of the upper and lower end turns being substantially U-shaped and having an arcuate long leg and an arcuate short leg joined by an arcuate connector having a bump, the arcuate long leg being at the free unknotted end of one of said end turns and the arcuate short leg being at the free unknotted end of the other of the end turns of the coil spring, the arcuate connector of one of the end turns being on the opposite side of the central spring axis than the arcuate connector of the other end turn of the coil spring, the coil springs being arranged in side-by-side rows and columns and being connected with each other at the upper and lower end turns by helical lacing wires, the coil springs being oriented the same direction in the spring core except the coil springs of the outermost columns of the spring core, every other one of the coil springs in each outermost column being flipped and rotated.

3. The product of claim 2 wherein one of the connectors of one of the end turns of said every other one of the coil springs in each outermost column is clipped to the same one of the upper and lower border wires.

4. The product of claim 2 wherein at least some of the coil springs are made from high tensile strength wire.

5. The product of claim 4 wherein said high tensile strength wire has a tensile strength greater than 290,000 psi.

6. The product of claim 4 wherein said high tensile strength wire has a tensile strength between 290,000 psi and 320,000 psi.

7. The product of claim 2 wherein the lateral distance between one of the legs of each end turn and the central spring axis is greater than the lateral distance between the other of the legs and the central spring axis.

8. The product of claim 2 wherein the lateral distance between one of the legs of each end turn and the central spring axis is at least two times greater than the lateral distance between the other of the legs and the central spring axis.

9. A bedding or seating product comprising:

a spring core comprising upper and lower border wires and a plurality of identically configured coil springs each made of a single piece of wire having a central spiral portion defining a central spring axis and terminating at opposing ends with unknotted upper and lower end turns disposed in planes substantially perpendicular to the spring axis, each of said upper and lower end turns being substantially U-shaped and having an arcuate long leg and an arcuate short leg joined by a connector having a bump, said long leg being at the free unknotted end of one of the end turns and said short leg being at the free unknotted end of the other of the end turns, the connector of one of the end turns being on the opposite side of the central spring axis from the connector of the other end turn, the coil springs being arranged in side-by-side rows and columns and connected with each other at the upper and lower end turns by helical lacing wires, the coil springs being oriented the same direction in the spring core except the coil springs of the outermost columns of the spring core, every other one of the coil springs in each of the outermost columns being clipped to only one of the upper and lower border wires.

10. The product of claim 9 wherein every other one of the coil springs in the outermost columns of coil springs is flipped and rotated relative to the remainder of the coil springs of the spring core.

11. The product of claim 9 wherein each of the coil springs is made from high tensile strength wire.

12. The product of claim 11 wherein said high tensile strength wire has a tensile strength greater than 290,000 psi.

13. The product of claim 11 wherein said high tensile strength wire has a tensile strength between 290,000 psi and 320,000 psi.

14. The product of claim 9 wherein the lateral distance between the long leg of one end turn and the central spring axis is greater than the lateral distance between the short leg of the end turn and the central spring axis.

15. The product of claim 13 wherein the lateral distance between the long leg of one end turn and the central spring axis is at least two times greater than the lateral distance between the short leg of the end turn and the central spring axis.

16. A bedding or seating product comprising:

a spring core comprising upper and lower border wires and a plurality of identically configured coil springs each made of a single piece of wire having a central spiral portion defining a central spring axis and terminating at opposing ends with unknotted upper and lower end turns disposed in planes substantially perpendicular to the spring axis, each of the upper and lower end turns being substantially U-shaped and having a long leg and a short leg joined by a connector having a bump, each of the coil springs being made from high tensile strength wire, the coil springs being arranged in side-by-side rows and columns and connected with each other at the upper and lower end turns by helical lacing wires, the coil springs being oriented the same direction in the spring core except the coil springs of the outermost columns of the spring core, every other one of the coil springs in each of the outermost columns being clipped to only one of the upper and lower border wires.

17. The product of claim 16 wherein each of the coil springs has the connector f one of the end turns on the opposite side of the central spring axis as the connector of the other of the end turns.

18. The product of claim 16 wherein said high tensile strength wire has a tensile strength greater than 290,000 psi.

19. The product of claim 16 wherein said high tensile strength wire has a tensile strength between 290,000 psi and 320,000 psi.

20. A bedding or seating product comprising:

a spring core made up of upper and lower border wires and a plurality of identically configured coil springs each made of a single piece of wire having a central spiral portion defining a central spring axis and terminating at opposing ends with unknotted upper and lower end turns disposed in planes substantially perpendicular to the spring axis, each of the upper and lower end turns being substantially U-shaped and having an arcuate long leg and an arcuate short leg joined by a connector having a bump, each of the end turns terminating in a free end, the connector of one of the end turns being on the opposite side of the central spiral portion of the coil spring than the connector of the other end turn, the coil springs being arranged in side-by-side rows and columns and connected with each other at the upper and lower end turns by helical lacing wires, the coil springs being oriented the same direction in the spring core except the coil springs of the outermost columns of the spring core, every other one of the coil springs in each outermost column being clipped to only one of the upper and lower border wires.

21. The product of claim 20 wherein each of the coil springs is made from high tensile strength wire.

22. The product of claim 21 wherein said high tensile strength wire has a tensile strength greater than 290,000 psi.

23. The product of claim 21 wherein said high tensile strength wire has a tensile strength between 290,000 psi and 320,000 psi.

* * * * *

UNITED STATES PATENT AND TRADEMARK OFFICE

CERTIFICATE OF CORRECTION

PATENT NO. : 8,429,779 B2
APPLICATION NO. : 12/830522
DATED : April 30, 2013
INVENTOR(S) : Guido Eigenmann et al.

It is certified that error appears in the above-identified patent and that said Letters Patent is hereby corrected as shown below:

In the Specification:

Column 1

Line 59, after the words "Adjacent coil", insert --springs are connected to each other at their end turns with helical lacing--.

Column 6

Line 11, "FIG. 5 is view" should be --FIG. 5 is a view--.

Line 20, "view of alternative" should be --view of an alternative--.

Line 32, "view of alternative" should be --view of an alternative--.

Line 39, "view of alternative" should be --view of an alternative--.

Column 7

Line 38, "48, 50 are" should be --48, 50 is--.

Column 8

Line 24, "72, 74 are" should be --72, 74 is--.

Column 9

Line 57, "enables" should be --enable--.

Signed and Sealed this
Thirtieth Day of July, 2013

Teresa Stanek Rea
*Acting Director of the United States Patent and Trademark Office*

In the Specification:

Column 10

Line 51, “72a, 74a are” should be --72a, 74a is--.

Column 12

Line 67, “72b, 74b are” should be --72b, 74b is--.

Column 15

Line 4, “joins” should be --join--.

Column 16

Line 53, “applicant’s” should be --applicants’--.

In the Claims:

Column 18

Lines 34-42, reverse the order of claims 14 and 15.

Line 63, “f” should be --of--.